US009235951B2

(12) United States Patent
Taylor

(10) Patent No.: US 9,235,951 B2
(45) Date of Patent: Jan. 12, 2016

(54) ELECTRONIC GAMING DEVICE WITH ADDITIONAL REEL FUNCTIONALITY

(71) Applicant: Laura Taylor, Atlanta, GA (US)

(72) Inventor: Laura Taylor, Atlanta, GA (US)

(73) Assignee: Cadillac Jack, Duluth, GA (US)

( * ) Notice: Subject to any disclaimer, the term of this patent is extended or adjusted under 35 U.S.C. 154(b) by 0 days.

(21) Appl. No.: 13/718,779

(22) Filed: Dec. 18, 2012

(65) Prior Publication Data

US 2014/0171174 A1 Jun. 19, 2014

(51) Int. Cl.
*A63F 9/24* (2006.01)
*G07F 17/32* (2006.01)

(52) U.S. Cl.
CPC ..... *G07F 17/32* (2013.01); *G07F 17/3265* (2013.01)

(58) Field of Classification Search
USPC ..... 463/16–20; 273/138.1, 139, 138.2
See application file for complete search history.

(56) References Cited

U.S. PATENT DOCUMENTS

| | | | | |
|---|---|---|---|---|
| 6,251,013 | B1 * | 6/2001 | Bennett | 463/13 |
| 8,469,793 | B2 * | 6/2013 | Visser | 463/20 |
| 2006/0068892 | A1 * | 3/2006 | Gomez et al. | 463/20 |
| 2006/0160595 | A1 * | 7/2006 | Gerson et al. | 463/16 |
| 2006/0189377 | A1 * | 8/2006 | Gomez et al. | 463/20 |
| 2006/0189378 | A1 * | 8/2006 | Aoki | 463/20 |
| 2012/0077566 | A1 * | 3/2012 | Schultz et al. | 463/20 |
| 2012/0088567 | A1 * | 4/2012 | Aoki et al. | 463/20 |
| 2012/0184355 | A1 * | 7/2012 | Gauselmann | 463/25 |
| 2012/0231872 | A1 * | 9/2012 | Shackelford et al. | 463/20 |

* cited by examiner

*Primary Examiner* — Jay Liddle
*Assistant Examiner* — Alex F. R. P. Rada, II
(74) *Attorney, Agent, or Firm* — Weide & Miller, Ltd.

(57) ABSTRACT

Examples disclosed herein relate to systems and methods, which may receive wagers on one or more paylines. The systems and methods may utilize one or more additional reel game functionality. The systems and methods may determine one or more payouts based on the one or more additional reel game functionality. The systems and methods may display one or more presentations based on the one or more additional reel game functionality.

18 Claims, 20 Drawing Sheets

ELECTRONIC GAMING DEVICE WITH ADDITIONAL REEL FUNCTIONALITY

FIELD

The subject matter disclosed herein relates to an electronic gaming device. More specifically, the disclosure relates to an electronic gaming device, which provides game play with one or more additional reel functionalities. Further, the disclosure relates to utilizing additional reel functionality and additional reel presentations in the base game and/or the bonus game to enhance the gaming experience.

INFORMATION

The gaming industry has numerous casinos located both worldwide and in the United States. A client of a casino or other gaming entity may gamble via various games of chance. For example, craps, roulette, baccarat, blackjack, and electronic games (e.g., a slot machine) where a person may gamble on an outcome.

Paylines of an electronic gaming device (e.g., a slot machine) are utilized to determine when predetermined winning symbol combinations are aligned in a predetermined pattern to form a winning combination. A winning event occurs when the player successful matches the predetermined winning symbols in one of the predetermined patterns. One or more combinations of symbols may generate a bonus game.

Players want new and exciting game options to maintain the player's enjoyment. A new way of delivering game play may include providing additional reel functionality and/or additional reel presentations in the base game and/or the bonus game.

BRIEF DESCRIPTION OF THE FIGURES

Non-limiting and non-exhaustive examples may be described with reference to the following figures, wherein like reference numerals refer to like parts throughout the various figures.

DETAILED DESCRIPTION

Figure 1:
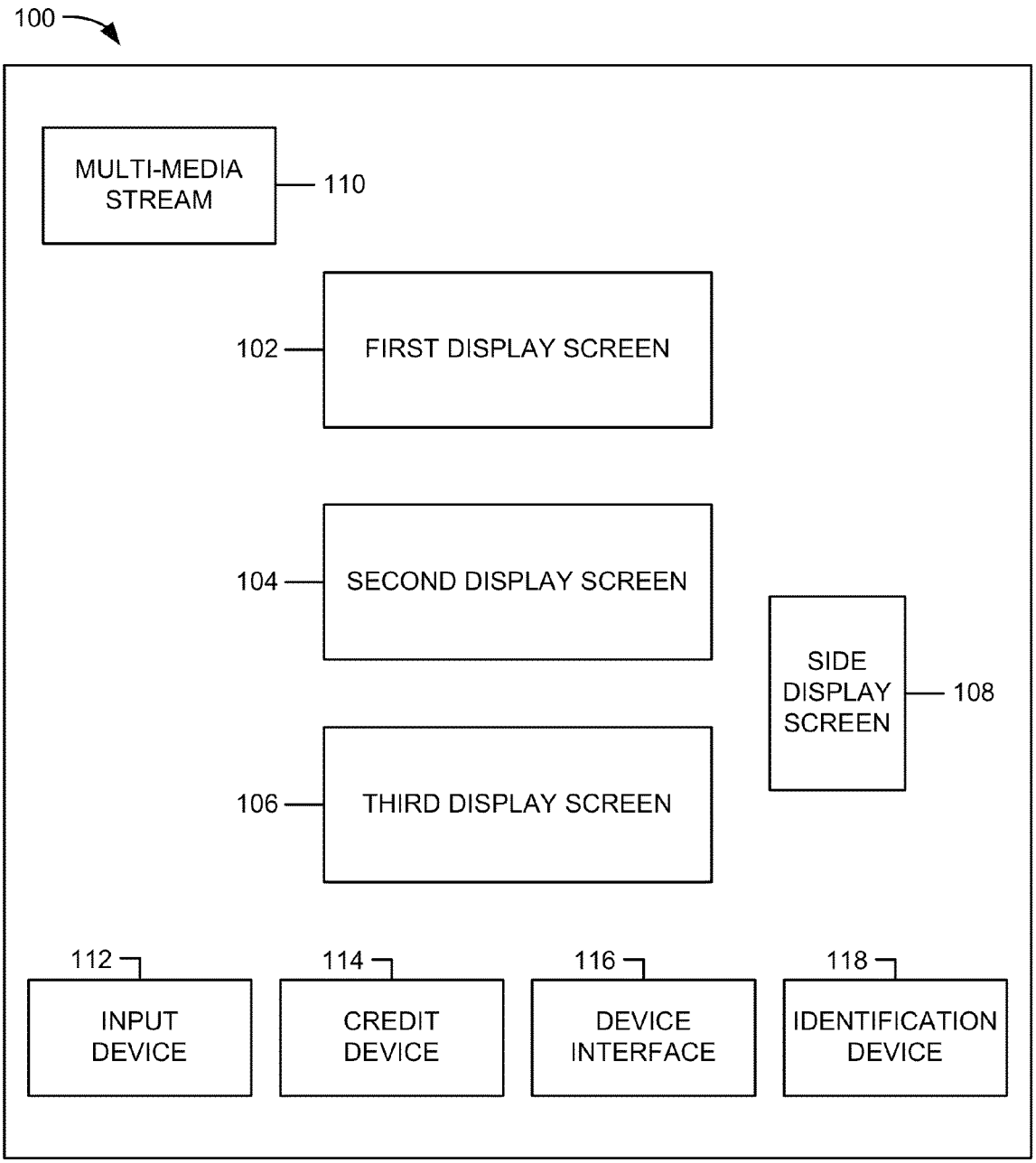
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, and/or any combination thereof. Input device 112 may be utilized to make a wager, to select additional reel game play, to select additional reel game play criteria, to select one or more additional reel gaming functionality, to control any object, to control any gaming feature, to select one or more pattern gaming options, to obtain data relating to historical payouts, to select a row and/or column to move, to select a row area to move, to select a column area to move, to select a symbol to move, to modify electronic gaming device 100 (e.g., change sound level, configuration, font, language, etc.), to select a movie or song, to select live multimedia streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.).

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, one or more additional reel functionalities (e.g., additional reel profile 1, additional reel profile 2, additional reel profile 3, $5^{th}$ reel functionality, super wheel functionality, ticker functionality, etc.) may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, a player may want to have game play options, which have only additional reel functionality (or similar functionality). Therefore, no games without additional reel functionalities (e.g., additional reel profile 1, additional reel profile 2, additional reel profile 3, $5^{th}$ reel functionality, super wheel functionality, ticker functionality, etc.) would be presented. In another example, the player may only want to play games that include pattern gaming options only. Therefore, only games which include pattern gaming options would be presented to the player. In another example, the player may only want to play games that include historical information relating to game play. Therefore, only games which include historical gaming data would be presented to the player. These examples may be combined.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player may be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 may then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

For example, a single large image may be partially displayed on second display screen 104 and partially displayed on third display screen 106, so that when both display screens are put together they complete one image. Electronic gaming device 100 may stream or play prerecorded multi-media data, which may be displayed on any display combination.

Figure 2:
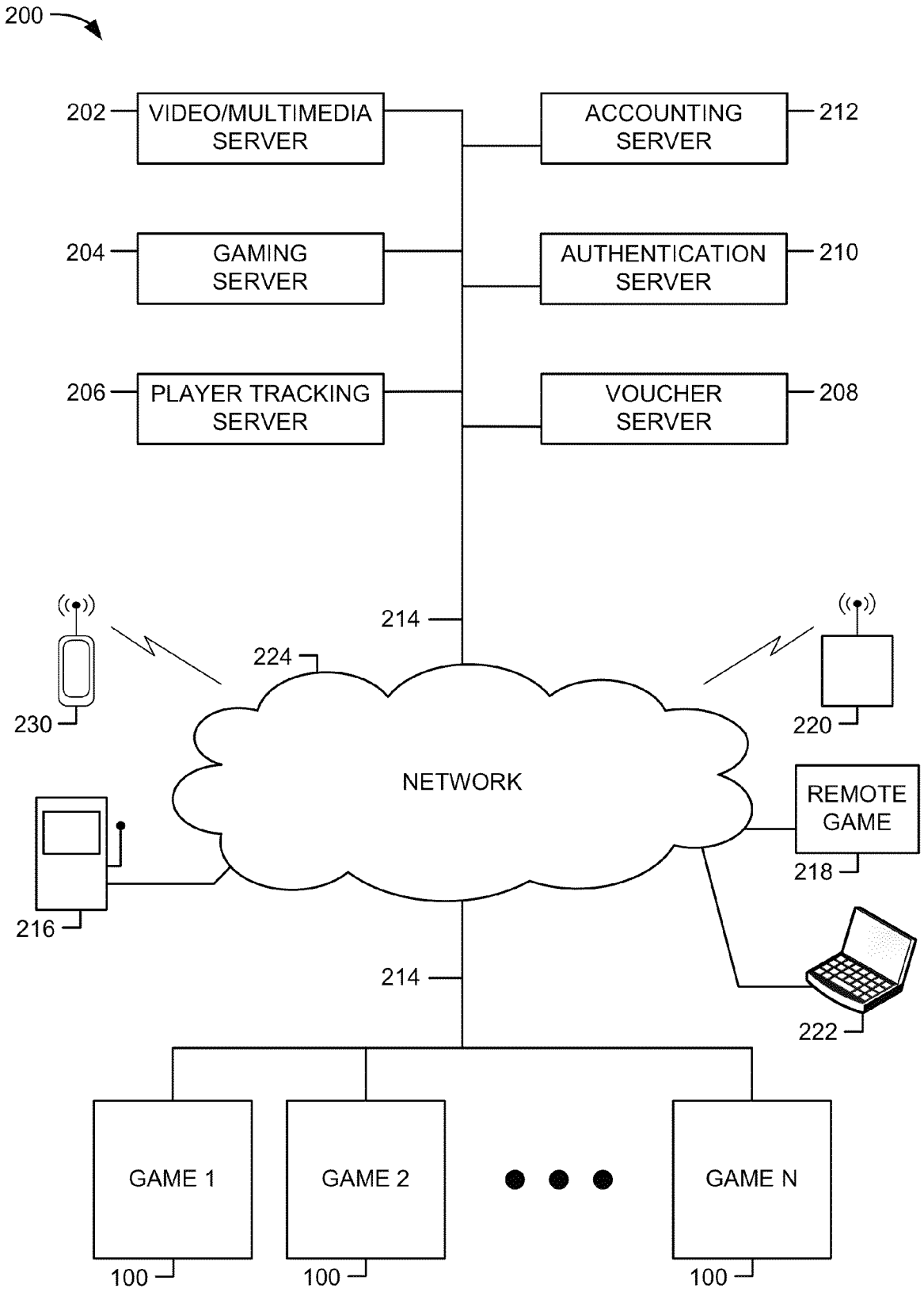
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, an accounting server 212, and an additional reel server 240.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of a payout functionality, an additional reel functionality, an additional reel evaluation functionality, other game functionality, and/or any virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include payline structure option selections. In addition, the voucher may include additional reel game play data (or similar game play data), repeat payline data, pattern data, historical payout data, column data, row data, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

Additional reel server 240 may generate, compile, track, and/or store data relating to one or more additional reel games, additional reel profiles, additional reel gaming results, and/or any data relating to additional reel. Additional reel server 240 may relate any of this data to one or more players.

A statistics server may be used to maintain data relating to historical game play for one or more electronic gaming devices 100. This historical data may include winning amounts, additional reel criteria, additional reel profiles, additional reel winning frequency, any other additional reel data, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Statistics server may include data relating to one or more additional reel game play (or similar game play). This data may include the number of times a specific item functionalities (e.g., additional reel profile 1, additional reel profile 2, additional reel profile 3, $5^{th}$ reel functionality, super wheel functionality, ticker functionality, etc.) was selected. The frequency of any specific item being selected and the amount won.

Figure 3:
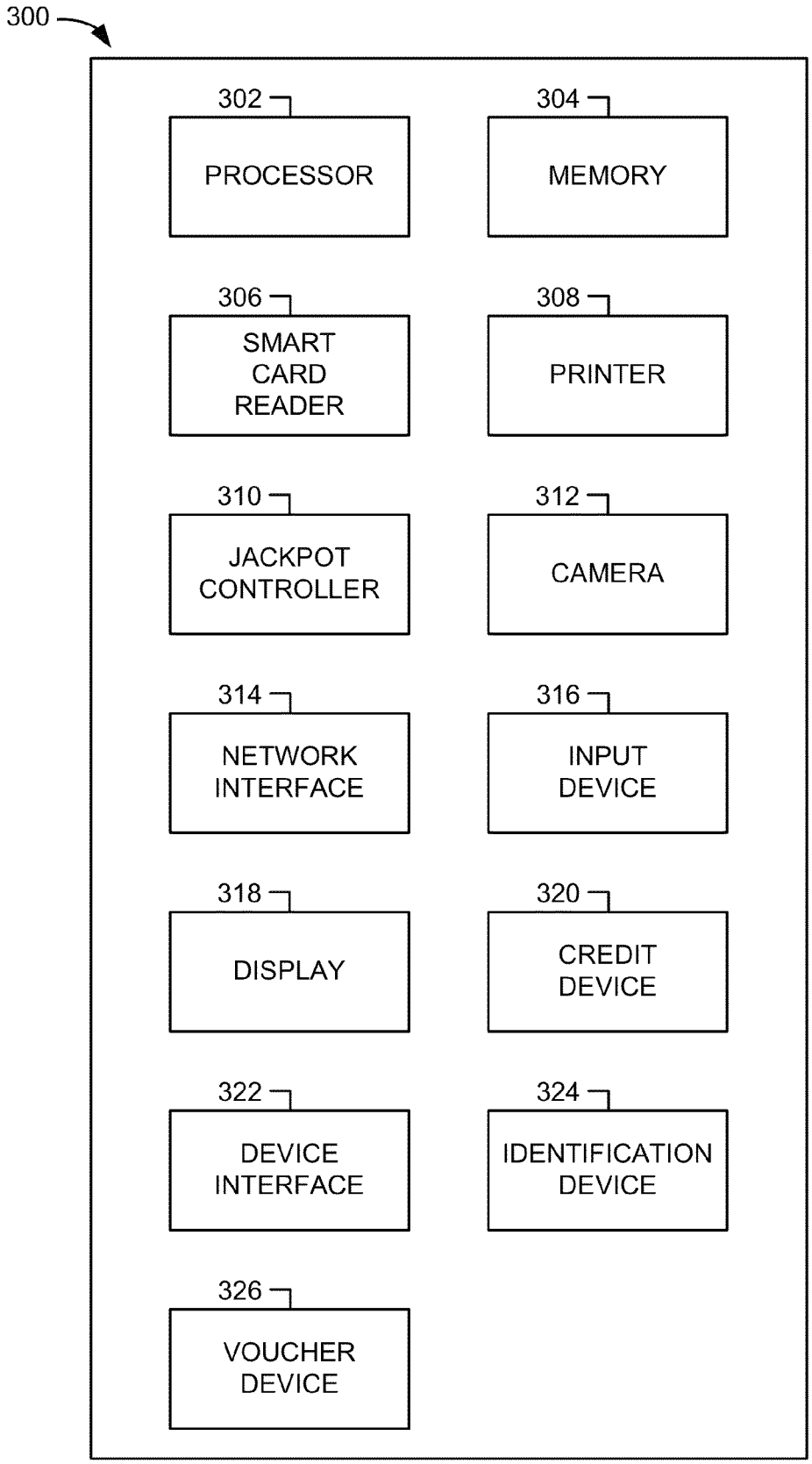
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine their picture may be taken to include his or her image into the game play. A picture of a player may be an actual image as taken by camera 312. A picture of a player may be a computerized caricature of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, accounting server 212, and/or additional reel server 240.

Input device 316 may be mechanical buttons, electronic buttons, a touch screen, and/or any combination thereof. Input device 316 may be utilized to make a wager, to select additional reel, to select additional reel criteria, to select one or more game elements, to select one or more additional reel functionality (e.g., additional reel profile 1, additional reel profile 2, additional reel profile 3, $5^{th}$ reel functionality, super wheel functionality, ticker functionality, etc.), to make an offer to buy or sell a voucher, to determine a vouchers worth, to cash in a voucher, to modify electronic gaming device 100 (e.g., change sound level, configuration, font, language, etc.), to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, additional reel profiles, additional reel criteria, an additional reel element, an additional reel functionality, and/or the tables utilized may be modified based on player preference data.

For example, a player may have selected a specific baseball team (e.g., Atlanta Braves) under the sporting event preferences, the electronic gaming device 100 may then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent a reward, which may be used at other locations inside of the gaming establishment. For example, the voucher may be a coupon for the local buffet or a concert ticket.

Figure 4:
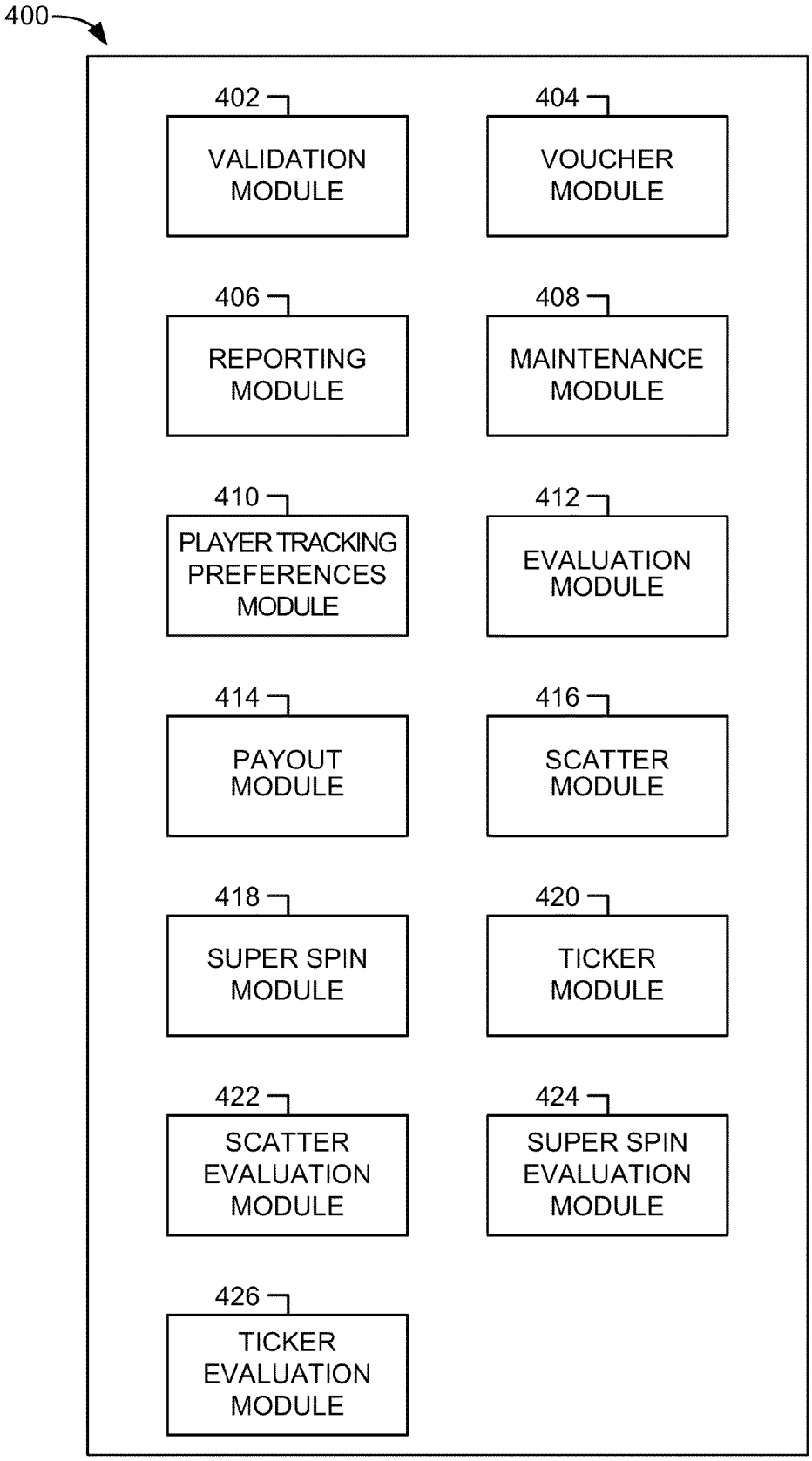
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, an evaluation module 412, a payout module 414, a scatter module 416, a super spin module 418, a ticker module 420, a scatter evaluation module 422, a super spin evaluation module 424, and/or a ticker evaluation module 426.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Evaluation module 412 may evaluate one or more outcomes for one or more events which may not be based on one or more outcomes for one or more additional reel based game play (e.g., additional reel profile 1, additional reel profile 2, additional reel profile 3, $5^{th}$ reel functionality, super wheel functionality, ticker functionality, etc.). Evaluation module 422 may evaluate one or more outcomes for one or more events which may be based on one or more outcomes for one or more additional reel based game play.

Payout module 414 may determine one or more payouts which may relate to one or more inputs received from the player, electronic gaming device 100, and/or electronic gaming system 200. Payout module 414 may determine one or more payouts relating to paylines, symbols, ticker data, super wheel data, $5^{th}$ reel data, reel data, and/or any other data.

Scatter module 416 may generate, compile, transmit, and/or store one or more scatter game play structures. Scatter module 416 may generate, compile, transmit, and/or store any data relating to scatter symbols and/or one or more scatter game play structures.

Super spin module 418 may generate, compile, transmit, and/or store one or more super wheel game play structures. Super spin module 418 may generate, compile, transmit, and/or store any data relating to super wheel gaming options and/or one or more super wheel game play structures.

Ticker module 420 may generate, compile, transmit, and/or store one or more ticker game play structures. Ticker module 418 may generate, compile, transmit, and/or store any data relating to ticker gaming options and/or one or more ticker game play structures.

Scatter evaluation module 422 may determine one or more payouts based on one or more scatter symbols, one or more scatter structures, and/or any other scatter data.

Super spin evaluation module 424 may determine one or more payouts based on one or more super wheel symbols, one or more super wheel game play structures, and/or any other super wheel data.

Ticker evaluation module 426 may determine one or more payouts based on one or more ticker symbols, one or more ticker game play structures, and/or any other ticker data.

An additional reel module may generate, compile, track, and/or store data relating to one or more additional reel games, additional reel profiles, additional reel gaming results, and/or any data relating to additional reel. Additional reel module may relate any of this data to one or more players. For example, player 1 may prefer an additional reel gaming profile, which focuses on super wheel game play. Whereas, player 2 may prefer an additional reel gaming profile, which focuses on ticker game play.

Additional reel evaluation module may evaluate one or more outcomes for one or more events which may be based on one or more outcomes for one or more additional reel based game play.

A bonus module may generate a bonus game, evaluate the results of the bonus game, trigger bonus game presentations, generate bonus game payouts, and/or display any data relating to the bonus game.

A presentation generation module may generate the presentation data (e.g., visual and audio) relating to one or more game play options. A presentation module may display one or more of the generated presentations.

It should be noted that one or more modules may be combined into one module. Further, there may be one evaluation module where the determined payout does not depend on whether there were any wild symbols, scatter symbols, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

Figure 5A:
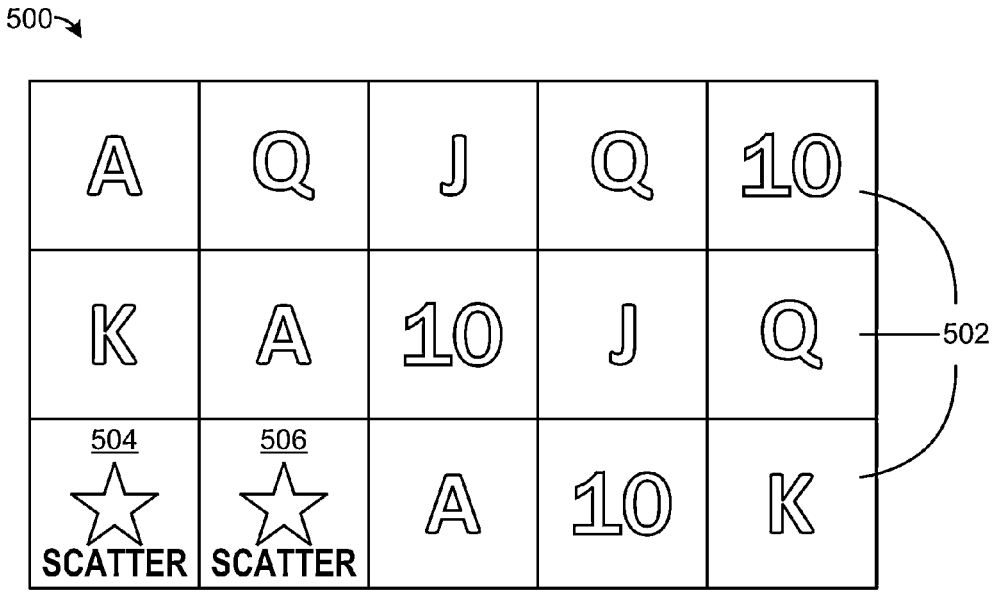
FIG. 5A is an illustration of a game play, according to one embodiment.

FIG. 5A is an illustration of a game play, according to one embodiment. A first image 500 may include a plurality of reels 502, a first scatter image 504, and a second scatter image 506. First image 500 may include plurality of reels 502 after a spin has occurred, which may contain any number of images. For example, the images may include a bar, a number, an icon, a picture, a scatter symbol, and/or any other image may be utilized. These images may be any image determined by electronic gaming device 100 and/or electronic system 200, the player's preferences saved on their player's card, and/or any other image. Plurality of reels 502 may spin vertically, horizontally, and/or in any pattern. The scatter symbol may be a predetermined symbol. For example, in one embodiment, first scatter image 504 and second scatter image 506 are stars. In this example, three scatter symbols are needed for the player to win, but only two scatter symbols have occurred. Another example may be that four scatter images are needed for the player to win, but only three occurred. Another example may be that five scatter images are needed for the player to win, but only four occurred, and/or any other combination of numbers. Any of the images may move in any way (e.g., wiggle, blink, expand, shrink, etc.).

Figure 5B:
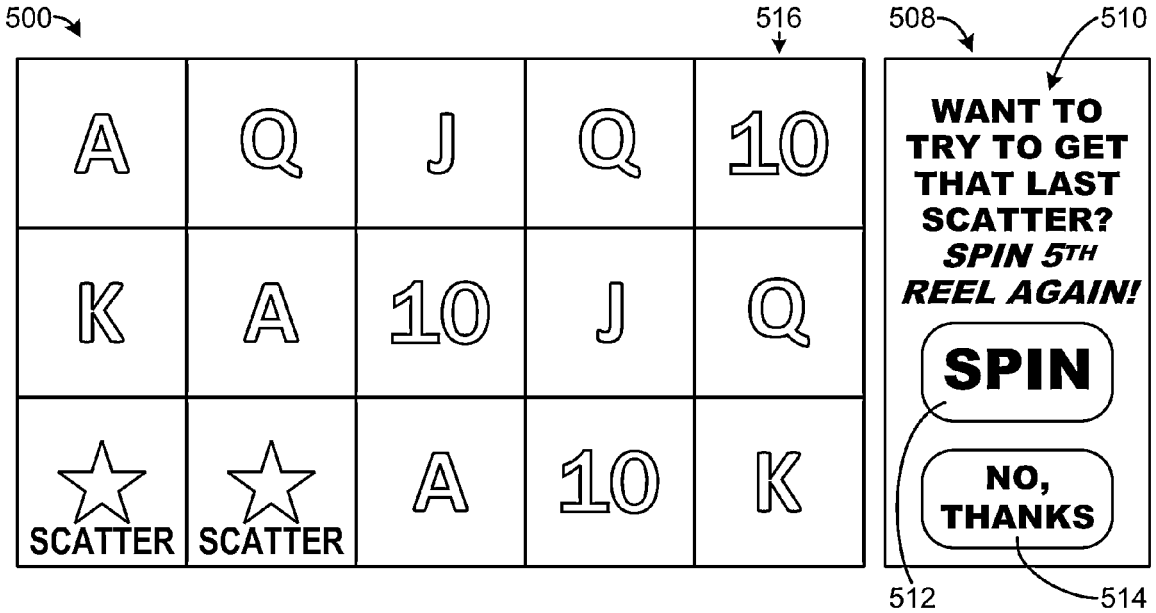
FIG. 5B is an illustration of a game play with a pop-up message, according to one embodiment.

FIG. 5B is an illustration of a game play with a pop-up message, according to one embodiment. First image 500 may include a fifth reel 516, a pop-up message area 508, a message line 510, a spin button 512, and a no, thanks button 514. After a spin has occurred, pop-up message area 508 may appear if the player has not won the game (or wants to try to obtain a bigger prize). Any number of scatter images (e.g., 1, 2, 3, 5, 10, etc.) may be needed for a winning event to occur. In this example, three scatter images are needed for a winning event. In another example, four scatter images may be needed. If a player has received two scatter images and would like to try to obtain additional scatter images, they may click on spin button 512 for another try. In another example, if a player has received two scatter images, but would not like to try again, they may click on no, thanks button 514. The option to respin may be given to a player any number of times (e.g., 1, 2, 3, 10, 20, etc.). Message line 510 may state, "Want to try to get that last scatter? Spin 5th reel again," and/or any other words. The player may have the option to select spin button 512 and/or no, thanks button 514. The option to spin a reel for an additional turn may be given to any player, selected players due to their frequency in the casino, selected players due to the number of profiles on their player card, a player's level, and/or any other criteria. In this example, first scatter image 504 and second scatter image 506 occurred in reel one and reel two, but the scatter images may occur in any location. In this example, the player was asked if they would like to spin fifth reel 516 again. The player may be asked if they would like to additionally spin any reel, any row, and/or any symbol areas. The player may pay an additional fee for a respin, the respin may use comps on the player's card, the respin may be awarded after the player has played a specified number of games, the respin may be randomly awarded, the respin may take a certain number of credits, the respin may be free, and/or any other criteria. The player may select spin button 512 if they would like an additional spin. The player may select no, thanks button 514 if the player would like to end the game. A player may select spin button 512 or no, thanks button 514 by clicking on it with a hand icon, by using the touch screen, by using the exterior buttons on electronic gaming device 100 and/or electronic system 200, and/or in any other way.

Figure 5C:
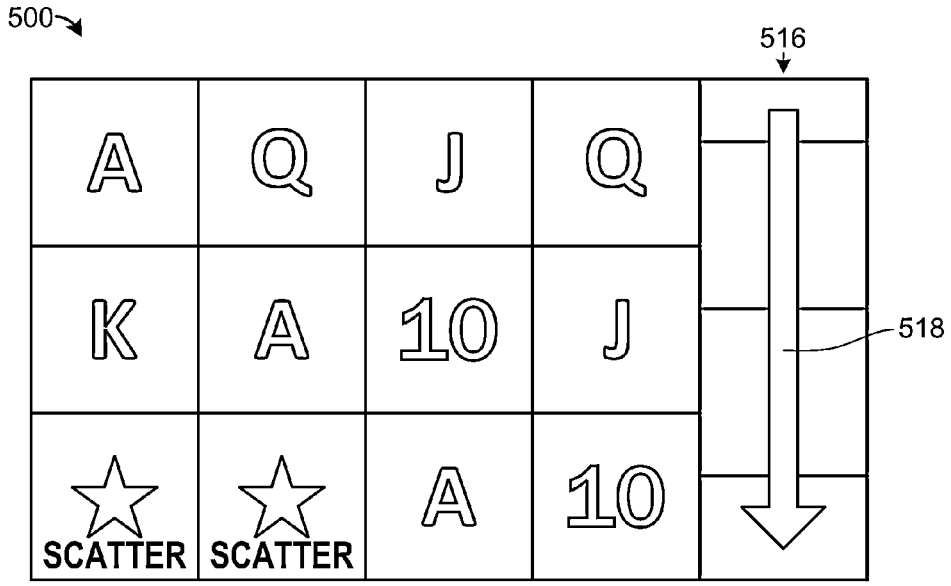
FIG. 5C is an illustration of a game play, according to one embodiment.

FIG. 5C is an illustration of a game play, according to one embodiment. First image 500 may include plurality of reels 502, fifth reel 516, and a respinning reel 518. In this example, the player has selected for fifth reel 516 to respin, which may be in the fifth reel, as it is in this example. Any reel may be chosen to be respun. Any of the reels, rows, and/or any symbol areas may be respun.

Figure 5D:
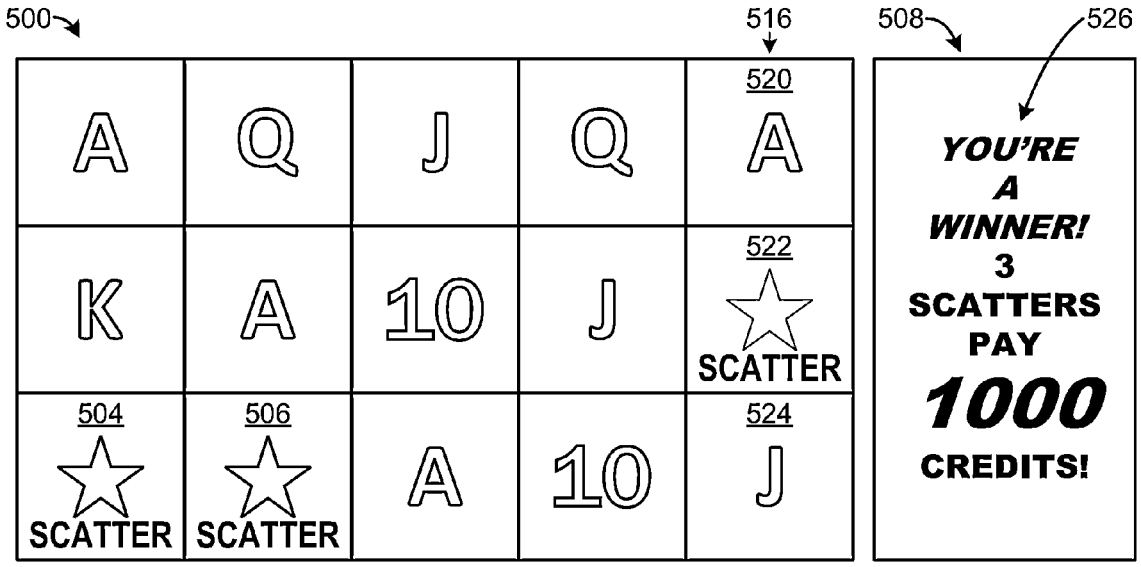
FIG. 5D is an illustration of a game play with a pop-up message, according to one embodiment.
Figure 5E:
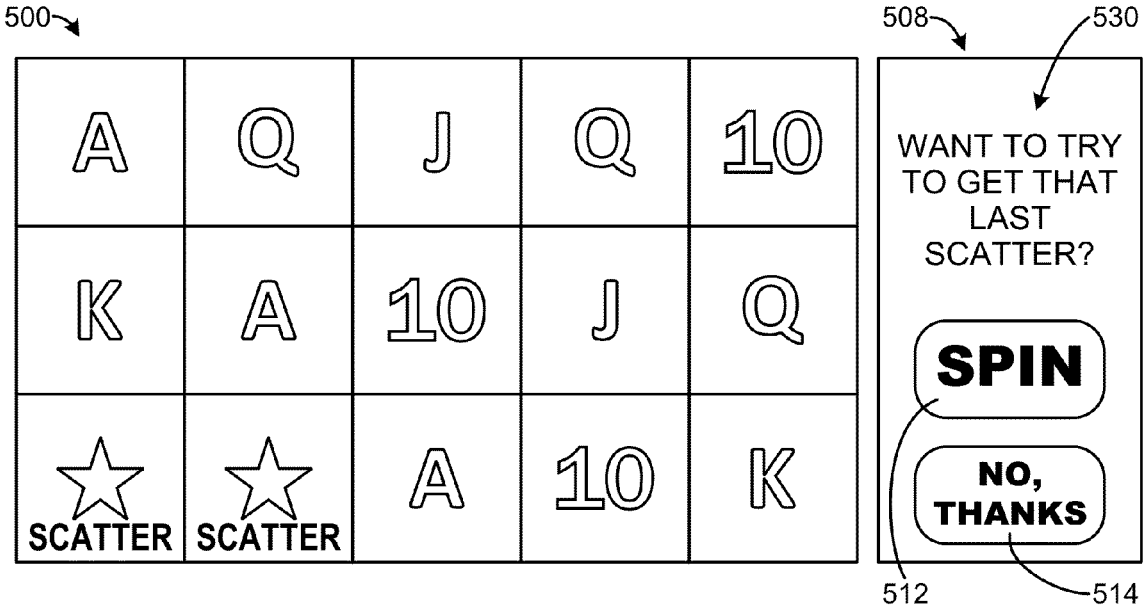
FIG. 5E is an illustration of a game play with a pop-up message, according to one embodiment.
Figure 5F:
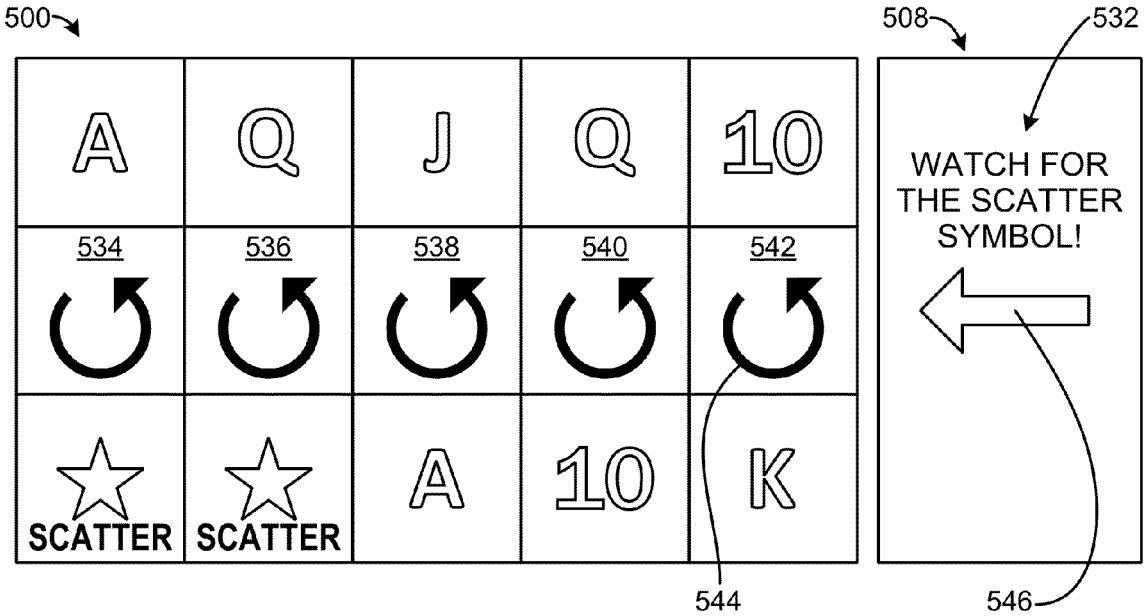
FIG. 5F is an illustration of a game play with a pop-up message, according to one embodiment.
Figure 5G:
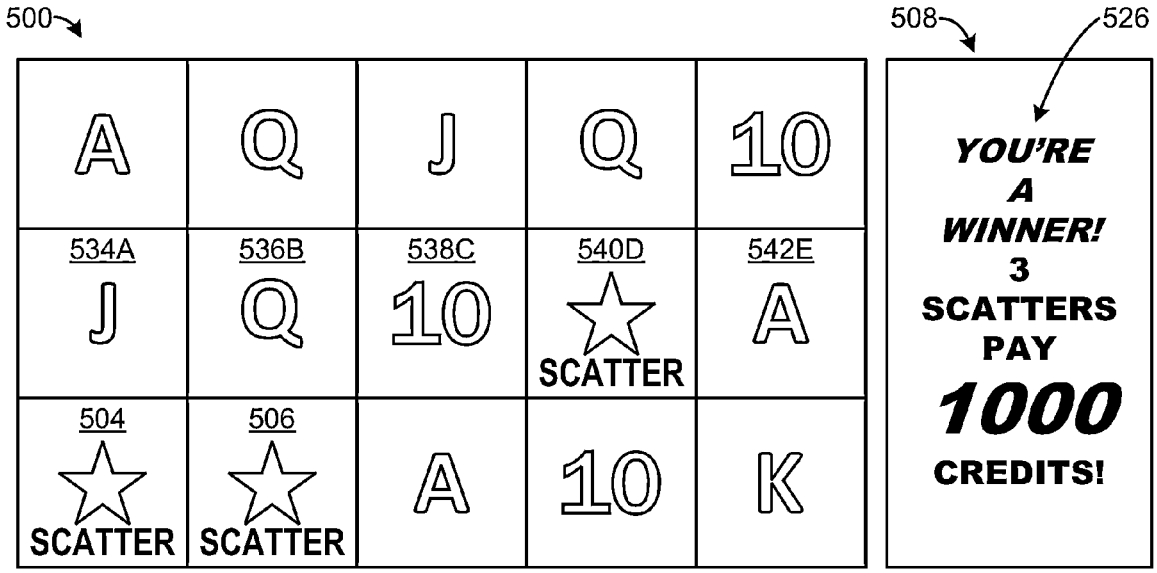
FIG. 5G is an illustration of a game play with a pop-up message, according to one embodiment.
Figure 5H:
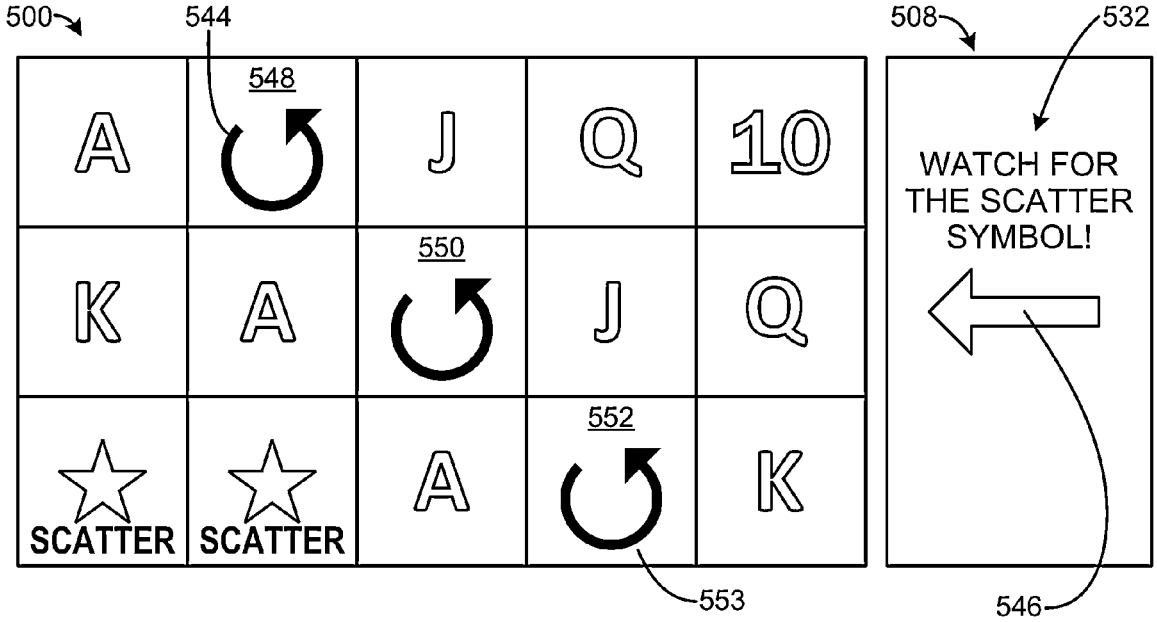
FIG. 5H is an illustration of a game play with a pop-up message, according to one embodiment.
Figure 5K:
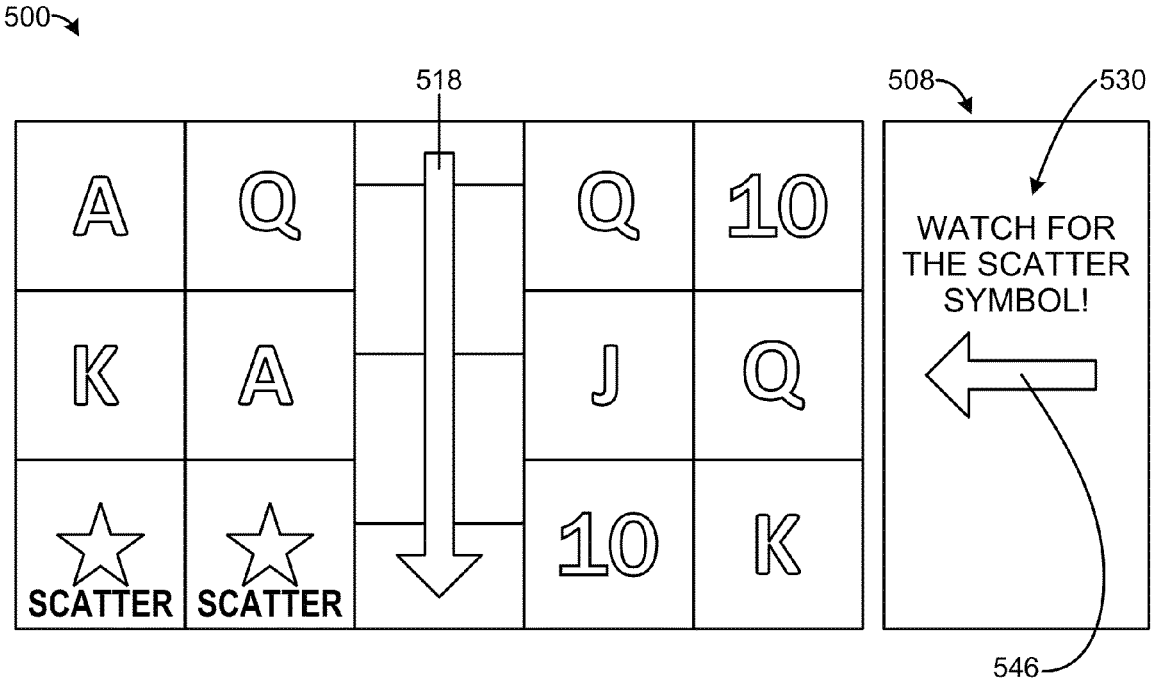
FIG. 5K is an illustration of a game play with a pop-up message, according to one embodiment.

For example, if a player has only two scatter images on their screen and would like to try for additional scatter images, the player may select to spin the fifth reel, and/or any other reel (See FIG. 5K and/or FIG. 5B). In another example, the selection process may be timed and/or require an additional time request by the player. In another example, if a player has three scatter images, and would like to try for additional scatter images, the player may select the second reel, and/or any other reel (see FIG. 5K and/or FIG. 5B). The player may also select any row (see FIG. 5F and/or FIG. 5G), and/or any image (see FIG. 5H, FIG. 5L, FIG. 5M, and/or FIG. 5N) to be respun.

FIG. 5D is an illustration of a game play with a pop-up message, according to one embodiment. First image 500 may include first scatter image 504, second scatter image 506, fifth reel 516, a first replacement image 520, a second replacement image 522, a third replacement image 524, a pop-up message 508, and a message 526. One possible outcome of the respin from FIG. 5C may be that the player wins. First replacement image 520, second replacement image 522, and third replacement image 524 may occur in fifth reel 516 when the reel has been respun. In this example, first replacement image 520 and third replacement image 524 are not winning images. In this example, second replacement image 522 is a scatter image, which gives the player three scatter images. In this example, three scatter images are needed for a winning event. When the winning event is triggered, pop-up message 508 may appear. The message may be on the right side of the screen, left side of the screen, middle of the screen, and/or any other location. Message 526 may state, "You're a winner! Three scatters pay 1000 credits," and/or any other words. In this example, three scatter symbols were needed for the player to win, but only two have occurred, which may prompt the player to decide if they want to spin again. In another example, four scatter images may be needed for the player to win, but only three occurred, which may prompt the player to decide if they want to spin again. Another example may be that five scatter images are needed for the player to win, but only four occurred, and/or any other combination of numbers (e.g., one of two, one of three, two of three, one of four, two of four, three of four, etc.).

If the respin does not end in a winning event for the player, the player may choose to respin any number of times (e.g., 1, 2, 3, 5, 10, etc.). A player may select any row, reel, symbol areas, and/or combination to respin (see FIG. 5B, FIG. 5C, FIG. 5F, FIG. 5H, FIG. 5K, and/or FIG. 5M). The option to spin a row, reel, and/or image for an additional turn may be given to any player, select players due to their frequency in the casino, selected players due to the number of profiles on their player card, and/or any other criteria. The respin may be for an additional cost. The cost may be points, player points, credits, and/or any other amount. The amount may be based on the level of a player's card. The amount may change daily (e.g., a casino may want a Take A Second Spin On Us Mondays and/or Respin for Half Cost Tuesdays), and/or any other promotion.

FIG. 5E is an illustration of a game play with a pop-up message, according to one embodiment. First image 500 may include pop-up message 508, message 530, spin button 512, and no, thanks button 514. In this example, three scatter images are needed for a win. The spin has occurred and only two scatter images occurred. Pop-up message 508 may appear asking what the player would like to do next. The message may be on the right side of the screen, left side of the screen, middle of the screen, and/or any other location. Message 530 may state, "Want to try to get that last scatter," and/or any other words. The player may have the option to select spin button 512 or no, thanks button 514. A player may select any row, reel, symbol areas, and/or combination to respin (see FIG. 5B, FIG. 5C, FIG. 5F, FIG. 5H, FIG. 5K, and/or FIG. 5M). The player may select spin button 512 if they would like to electronic gaming device 100 and/or electronic system 200 to spin a row for an additional time. In another example, electronic gaming device 100 and/or electronic gaming system 200 may determine (e.g., randomly, predetermined pattern, shuffle, based on player information, etc.) which row, column, and/or areas to be respun. The player may select no, thanks button 514 if the player would like to end the game. For example, if a player has received two scatter images and would like to try for additional scatter images, they may click on spin button 512 for another try. In another example, if a player has received two scatter images, but would not like to try again, they may click on no, thanks button 514. A player may select spin button 512 or no, thanks button 514 by clicking on it with a hand icon, by using the touch screen, by using the external buttons on electronic gaming device 100 and/or electronic system 200, and/or in any other way. The optional rows for respinning may be highlighted, moved, jiggled, and/or moved in any way. The player (and/or electronic gaming device 100 and/or electronic gaming system 200) may select any number of rows (e.g., 1, 2, 3, 4, 5, etc.) for respinning.

FIG. 5F is an illustration of a game play with a pop-up message, according to one embodiment. First image 500 may include a first respin symbol area 534, a second respin symbol area 536, a third respin symbol area 538, a fourth respin symbol area 540, a fifth respin symbol area 542, a spinning image 544, pop-up message 508, a message line 532, and an arrow 546. In this example, for a winning event, the player needs three scatter images. The player has received two scatter images and has opted to respin a row. In this example, the player has selected to respin the second row (see FIG. 5E), which may include first respin symbol area 534, second respin symbol area 536, third respin symbol area 538, fourth respin symbol area 540, and fifth respin symbol area 542. All of second row images may change when respun. The player may have the option to respin any row, symbol areas, and/or reel. Spinning image 544 may include an arrow and/or any other image that may show the images are changing (see FIG. 5H). Any of the images may blink, move, get bigger, get smaller, and/or change in any way. Pop-up message 508 may appear as the row is being respun and/or as it is spinning Pop-up message 508 may blink, shake, change size, change color, and/or change in any way. Message 532 may state, "Watch for the scatter symbol," and/or any other words. Arrow 546 may include an image of an arrow and/or any other image that may indicate where to look. Arrow 546 may blink, shake, change size, change color, and/or change in any way. A player may select any row, reel, symbol areas, and/or combination to respin (see FIG. 5B, FIG. 5C, FIG. 5H, FIG. 5K, and/or FIG. 5M).

FIG. 5G is an illustration of a game play with a pop-up message, according to one embodiment. Image 500 may include a first replacement symbol 534A, a second replacement symbol 534B, a third replacement symbol 536C, a fourth replacement symbol 540D, a fifth replacement symbol 542E, first scatter symbol 504, second scatter symbol 506, pop-up message 508, and message line 526. In this example, the player has selected the second row to be respun. First replacement symbol 534A, second replacement symbol 534B, third replacement symbol 536C, fourth replacement symbol 540D, and fifth replacement symbol 542E may appear on the second row after the respin. In this example, the player needed three scatter symbols for a winning event. In this example, the player won because first scatter symbol 504, second scatter symbol 506, and fourth replacement symbol 540D were scatter symbols. When a winning event occurs, pop-up message 508 may appear. Message 526 may state, "You're a winner! Three scatters pay 1000 credits," and/or any other words. If the outcome of the respin was not a winning outcome (e.g., in this game, a losing event may occur if none of the replacement images were a third scatter image), the player may be asked if they would like to respin again (See FIG. 5E), which in one example may require an additional payment (e.g., credits, banked free spins, etc.) from the player.

FIG. 5H is an illustration of a game play with a pop-up message, according to one embodiment. First image 500 may include a first respinning symbol 548, a second respinning symbol 550, a third respinning symbol 552, spinning image 544, pop-up message 508, message line 532, and arrow 546. In this example, the player needs three scatter images for a winning game. The player has received two scatter images and has opted to respin on a diagonal column. Spinning image 544 may include an arrow and/or any other image to show the images are changing during the respin. The images may blink, move, get bigger, get smaller, and/or change in any way. In this example, the player has selected to respin on a diagonal column, which may include first respinning symbol 548, second respinning symbol 550, third respinning symbol 552. All of selected images may change when respun. The player may have the option to respin any row, symbol areas, and/or reel. Arrow 546 may include an image of an arrow and/or any other image that may indicate which images are changing. Pop-up message 508 may appear as the images are being respun. Message 532 may state, "Watch for the scatter symbol," and/or any other words. A player may select any row, reel, symbol areas, and/or combination to respin (see FIG. 5B, FIG. 5C, FIG. 5F, FIG. 5K, and/or FIG. 5M). The option to spin a row, reel, and/or image for an additional turn may be given to any player, select players due to their frequency in the casino, selected players due to the number of profiles on their player card, and/or any other criteria. The respin may be for an additional cost. The cost may be free spins, player points, credits, and/or any other amount. The amount may be based on the level of a player's card. The amount may change daily (e.g., a casino may want Take A Second Spin On Us Mondays and/or Respin for Half Cost Tuesdays), and/or any other promotion. For example, a player may choose to respin if they have received two scatters when they need three scatters to win a game. A player may also choose to respin if they have received one scatter when they needed four to win, three scatters when they needed five to win, and/or any combination of numbers.

FIG. 5K is an illustration of a game play with a pop-up message, according to one embodiment. First image 500 may include respinning reel 518, pop-up message 508, message line 530, and arrow 546. In this example, the player has selected for the third reel, respinning reel 518, to respin. The optional respinning reel does not have to be the third reel. A player may select any row, reel, symbol areas, and/or combination to respin (see FIG. 5B, FIG. 5C, FIG. 5F, FIG. 5H, and/or FIG. 5M).

For example, a player may choose to respin if they have received two scatter images when they need three scatter images to win. A player may also choose to respin if they have received one scatter when they needed four to win, three scatters when they needed five to win, and/or any combination of numbers.

For example, if a player has only two scatter images on their screen and would like to take another chance at gaining additional scatter images, the player may select to spin the third reel, and/or any other reel (see FIG. 5C), an additional time.

Figure 5L:
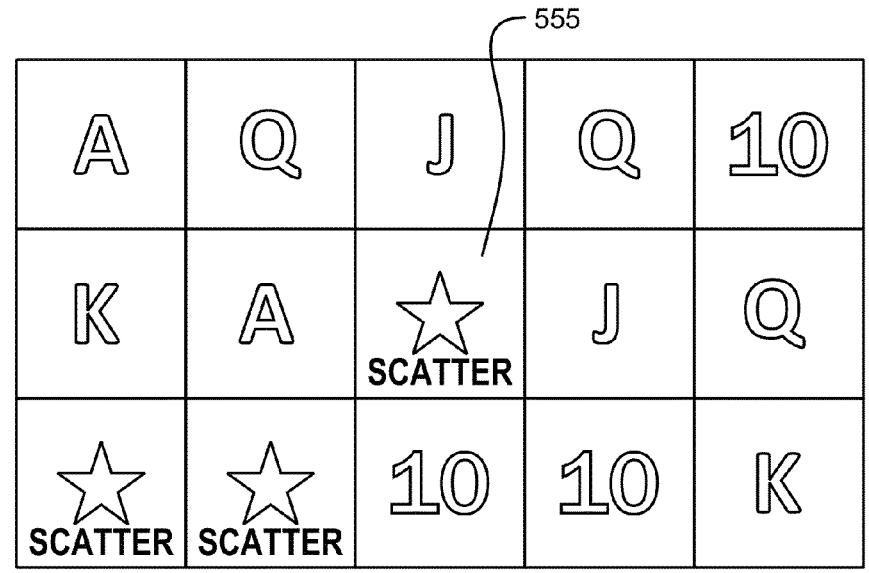
FIG. 5L is an illustration of a game play, according to one embodiment.

FIG. 5L is an illustration of a game play, according to one embodiment. First image 500 may include a scatter symbol 555. A possible outcome of the respin in FIG. 5K may be the player wins. A winning game may be achieved by scatter symbol 555 occurring on the respun third reel. In this example, the player may need three scatter symbols to achieve a winning event. When the player has respun the third reel (see FIG. 5K), any combination of images might have appeared. The player may have lost the game if no additional scatter symbols appeared. The player may then have been asked if they would like to respin (See FIG. 5E). The additional spin may be allowed for an additional cost. In one example, a first winning outcome may have occurred which is a small winning outcome. The player may be able to request a respin of one or more rows, columns, and/or areas, which may lead to a second winning outcome which is a bigger winning outcome then the first winning outcome. This request may entail additional payment (e.g., credits, banked free spins, etc.) from the player.

Figure 5M:
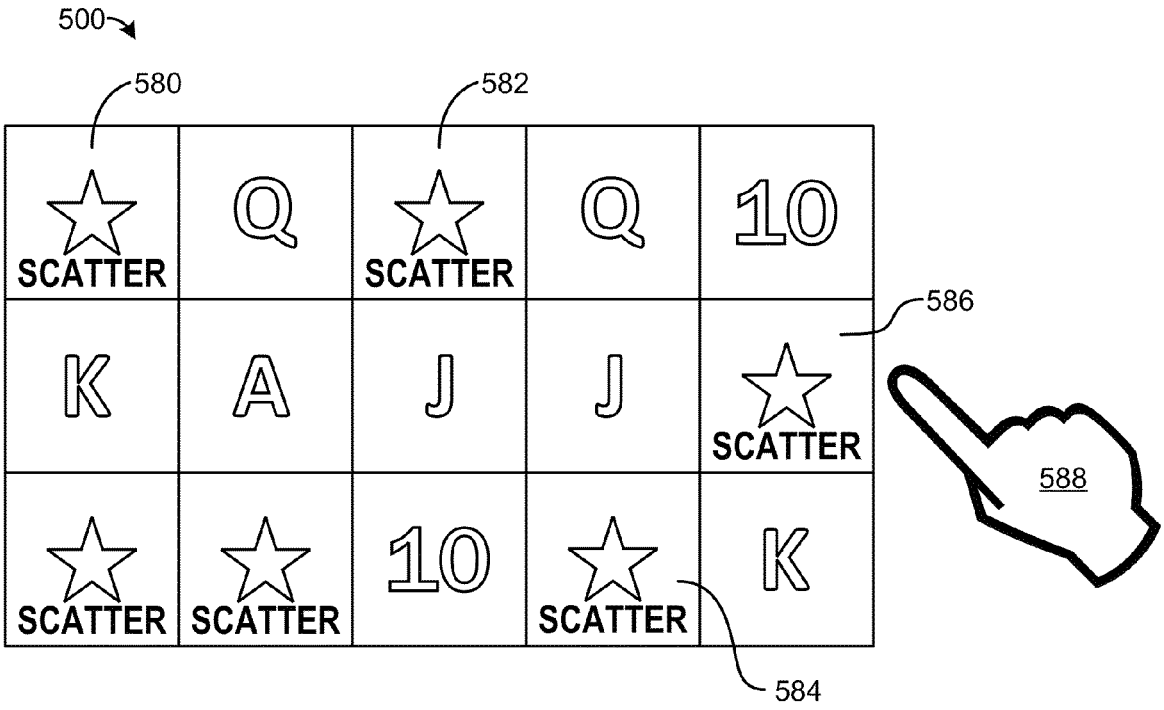
FIG. 5M is another illustration of a game play, according to one embodiment.

FIG. 5M is an illustration of a game play, according to one embodiment. First image 500 may include a first replacement image 580, a second replacement image 582, a third replacement image 584, a fourth replacement image 586, and a hand icon 588. In this example, the player has selected to respin first replacement image 580, second replacement image 582, third replacement image 584, and fourth replacement image 586. A player may select any row, reel, symbol areas, and/or combination to respin (see FIG. 5B, FIG. 5C, FIG. 5F, FIG. 5H, and/or FIG. 5K). Hand icon 588 may allow a player to select certain images on the screen. With hand icon 588, the player may click on any of the images. The player may also use the touch screen, use Kinect, motion detectors, verbal response, and/or any other selecting method.

For example, if a player has only two scatter symbols on their screen and would like to take another chance at a third scatter image, the player may select to spin first replacement image 580, second replacement image 582, third replacement image 584, and/or fourth replacement image 586. One outcome of a respin is FIG. 5M, in which a third scatter image occurs. Another outcome may be that a third scatter image does not occur and the player has lost the game. The player may then be asked if they would like to select another reel, row, and/or image to respin. In this example, all of first replacement image 580, second replacement image 582, third replacement image 584, and/or fourth replacement image 586 turned into scatter symbols.

Figure 5N:
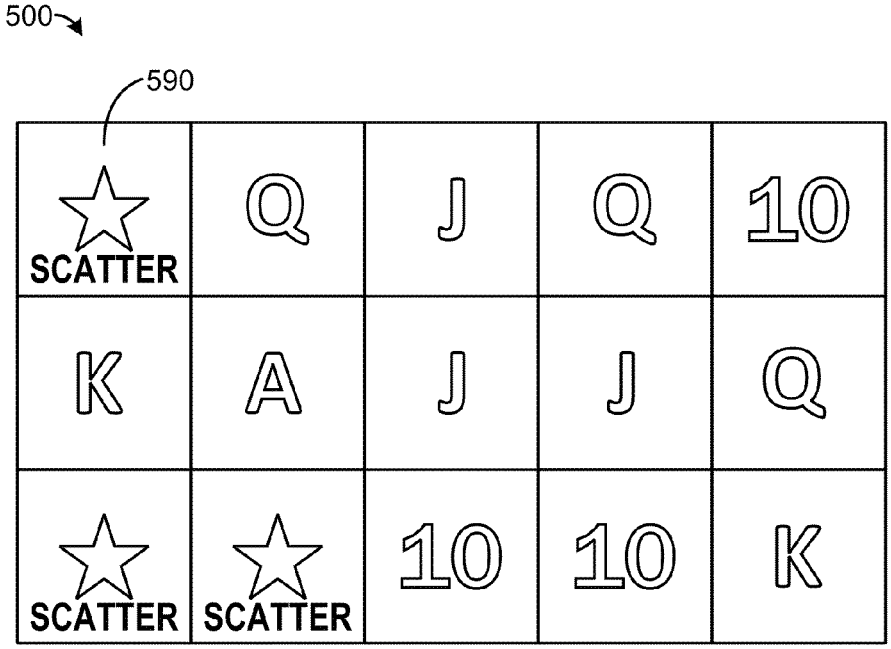
FIG. 5N is another illustration of a game play, according to one embodiment.

FIG. 5N is an illustration of a game play, according to one embodiment. First image 500 may include a third scatter symbol 590. In this example, the player has a winning number of scatter symbols. The player may have selected to respin certain images (see FIG. 5M) in order to potentially receive third scatter symbol 590. Third scatter symbol 590 may have occurred in any of the respun image locations. In another example, the player may have not won the game if no scatter image occurred in the respun images from FIG. 5M. A player may select any row, reel, symbol areas, and/or combination to respin (see FIG. 5B, FIG. 5C, FIG. 5F, FIG. 5H, FIG. 5K, and/or FIG. 5M).

The number of scatter symbols needed to win a game may also change depending on the game. In the example on FIG. 5N, three scatter symbols were needed, but any number (e.g., 1, 3, 4, 5, 6, etc.) of scatter symbols may be needed for a winning game.

Figure 6A:
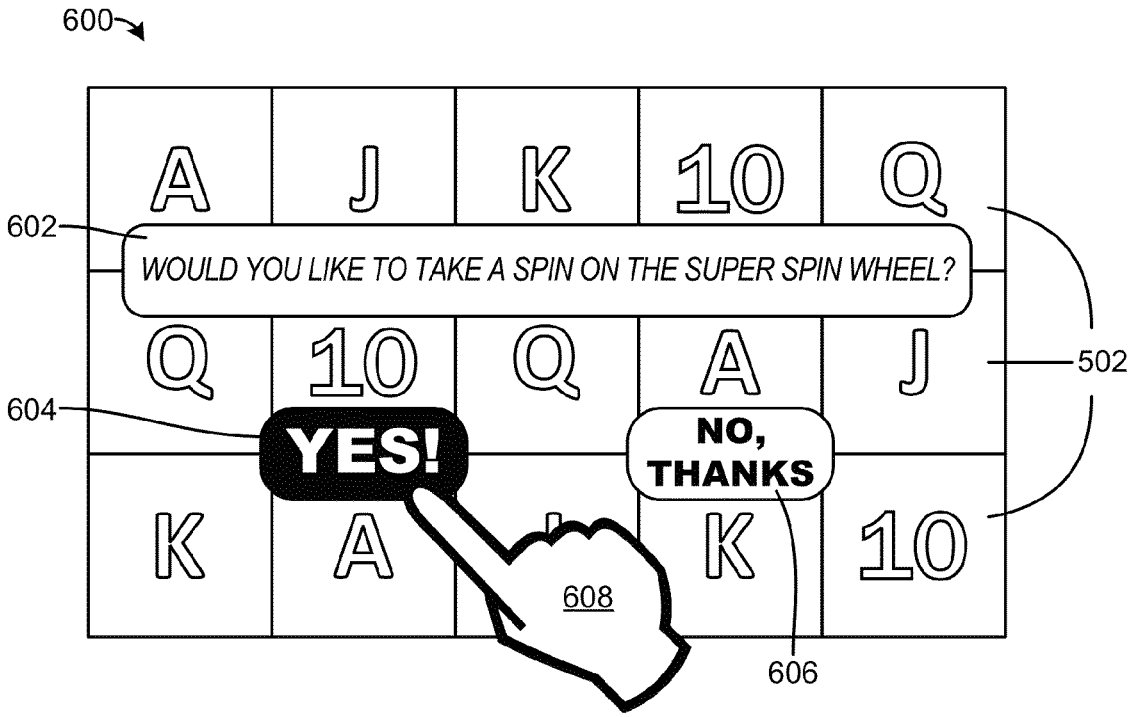
FIG. 6A is an illustration of a super wheel game play with a pop-up menu, according to one embodiment.

FIG. 6A is an illustration of a super wheel game play with a pop-up menu, according to one embodiment. A second image 600 may include plurality of reels 502, a pop-up message 602, a yes button 604, a no, thanks button 606, and a hand icon 608. In this example, a player may have selected to spin plurality of reels 502. Pop-up message 602 may state, "Would you like to take a spin on the super spin wheel," and/or any other words. Pop-up message 602 may blink, shake, change size, change color, and/or change in any way. The message may be on the right side of the screen, left side of the screen, middle of the screen, and/or any other location. A player may use hand icon 608 to select certain buttons on the screen. With hand icon 608 the player may click on yes button 608, no, thanks button 606, and/or any other buttons. The player may also use the touch screen, use Kinect, motion detectors, verbal response questions, and/or other selecting method. If the player selects yes button 608, the fifth reel may change into a super spin wheel (see FIG. 6B). If the player selects no button 606, the game may progress in normal mode. For example, four reels may spin and show one or more symbols in various areas on the matrix. If the no is selected, then the fifth reel has one or more symbols in various areas on fifth reel. If the yes is selected, then the fifth reel may be modified into a super spin wheel and the player is able to have super spin wheel rotate (e.g., spin, move, etc.).

Figure 6B:
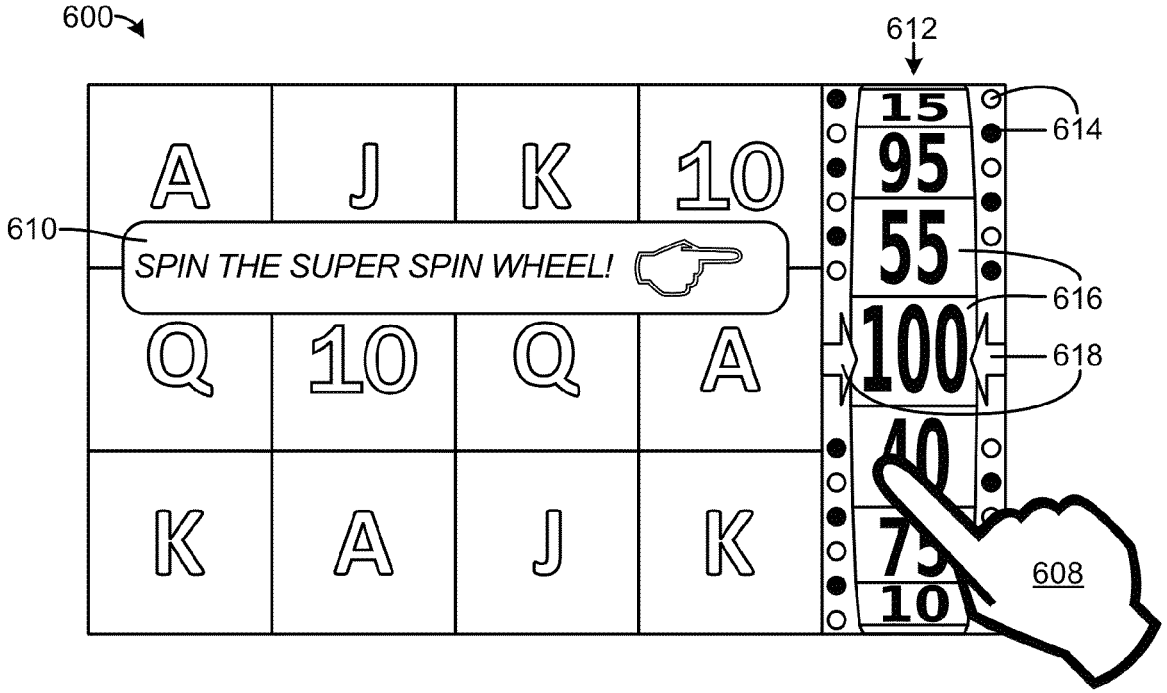
FIG. 6B is an illustration of a super wheel game play with a super spin wheel, according to one embodiment.

FIG. 6B is an illustration of a super wheel game play with one or more super spin wheels, according to one embodiment. Second image 600 may include a pop-up message 610, a super spin wheel 612, one or more light bulbs 614, one or more potential winning numbers 616, a ticker 618, and hand icon 608. In this example, a player may have selected to utilize super spin wheel 612 on the fifth reel. In this example, the first four reels may spin in normal mode, then the player may have the manual option to spin super spin wheel 612 using hand icon 608, the touch screen, a physical pull reel on the outside of the gaming device which may correspond to the spinning super wheel on the screen, and/or any other selecting method to manually start the game (and/or electronic gaming device 100 and/or electronic gaming system 200 may automatically start the game). In this example, the player may have clicked on yes button 608 when asked if they would like to use the super spin wheel (see FIG. 6A). Pop-up message 610 may state, "Spin the super spin wheel," and/or any other words. There may be an arrow pointing to the super spin wheel and/or any other images. Super spin wheel 612 may have any number (e.g., 0, 1, 2, 3, 5, 10, etc.) one or more light bulbs 614 in various colors, a single color, flashing, blinking, and/or moving in any way. Super spin wheel 612 may have one or more potential winning numbers 616 listed, which may be in any order (random, ascending, descending, etc.). When super spin wheel 612 is spinning, different potential winning numbers may appear. These numbers and/or awards may be multipliers, credits, free spins, and/or any other thing of value (e.g., food, hotel room, car, boat, trip, etc.). The spin may be from top to bottom, from bottom to top, and/or it may spin in any other way. When the spinning wheel stops spinning, whichever number is being pointed to by ticker symbol 618 may be the awarded amount (e.g., if the player spins super spin wheel 612, it may stop at the number 100, which may give the player 100 credits. In another example, the super spin wheel may stop with the ticker symbols pointing to the number 75, which may give the player 75 credits). Ticker 618 may be any color, size, and/or shape. A player may select any row, reel, and/or image to spin as a super spin wheel (see FIG. 6C and FIG. 6D). In this example, the player selected the fifth reel as the super spin wheel, but any of the reels (e.g., first, second, third, fourth, and/or fifth) may be selected. The images on the super spin wheel may include a number, a bar, an icon, a picture, a scatter symbol, and/or any other image. The images may be any image determined by electronic gaming device 100 and/or electronic system 200, the player's preferences saved on their player's card, and/or any other image. The images may also flash, jiggle, and/or move in any way. The option to utilize super spin wheel 612 may occur for an additional cost. The option to spin images, rows, and/or reels for an additional turn may be given to any player, select players due to their frequency in the casino, selected players due to the number of profiles on their player card, a player's card level, and/or any other criteria. Super spin wheel 612 may cost points, player points, credits, and/or any other amount. The amount may be based on the level of a player's card and/or any other criteria. The amount may change daily (e.g., a casino may want Take A Super Spin On Us Mondays and/or Super Spin for Half Cost Tuesdays), and/or any other promotion.

Figure 6C:
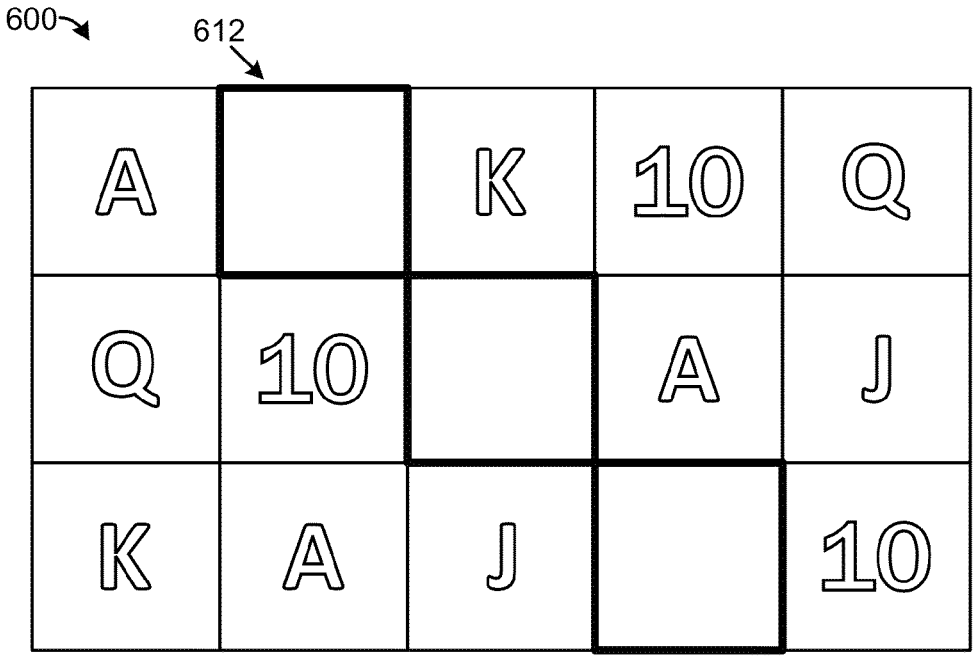
FIG. 6C is an illustration of a super wheel game play, according to one embodiment.

FIG. 6C is an illustration of a super wheel game play, according to one embodiment. Second image 600 may include a super spin wheel in a diagonal column 612. In this example, a player may have selected to utilize a super spin wheel in diagonal column 612. In this example, the player may have clicked on yes button 608 when asked if they would like to use the super spin wheel (see FIG. 6A). The player may have then selected which diagonal slots they want to use as super spin wheels. Then the first and fifth reels may have spun in normal mode. The symbols in reels 2, 3, and 4 that are not included in super wheel may also be spun as normal. Then the player may have been given the manual option to spin the super wheel using hand icon 608, the touch screen, a physical pull reel on the outside of the gaming device which may correspond to the spinning super wheel on the screen, and/or any other selecting method to manually start the super spin wheel game. The super spin wheel may have any number (e.g., 0, 1, 2, 3, 5, 10, etc.) of one or more light bulbs 614 (see FIG. 6B) in various colors, a single color, flashing, blinking, and/or moving in any way. Super spin wheel 612 may have potential winning number 616 listed, which may be in any order (random, ascending, descending, etc.). When the super wheel is spinning, different potential winning numbers may appear. The spin may be from top to bottom, or from bottom to top, and/or it may spin in any other way. When the spinning wheel stops spinning, whichever number is being pointed to by ticker symbol 618 may be the awarded amount (e.g., if the player spins the super spin wheel, it may stop at the number 100, which may give the player 100 credits. In another example, the super spin wheel may stop with the ticker symbols pointing to the number 75, which may give the player 75 credits). In another example, the super spin wheel may stop in a position that completes one or more paylines (e.g., with symbols that complete a winning symbol combination), which rewards the player with one or more prizes.

In this example, the player selected the first box in the second reel, the second box in the third reel, and the third box in the fourth reel for the super spin wheel, but any variation of rows, reels, and/or images may be selected. If the player wanted to use a different diagonal column, for example, the player may select the first box in the first reel, the second box in the second reel, and the third box in the third reel. In another example, the player may select the third box in the third column, the second box in the fourth column, and the first box in the fifth column.

Figure 6D:
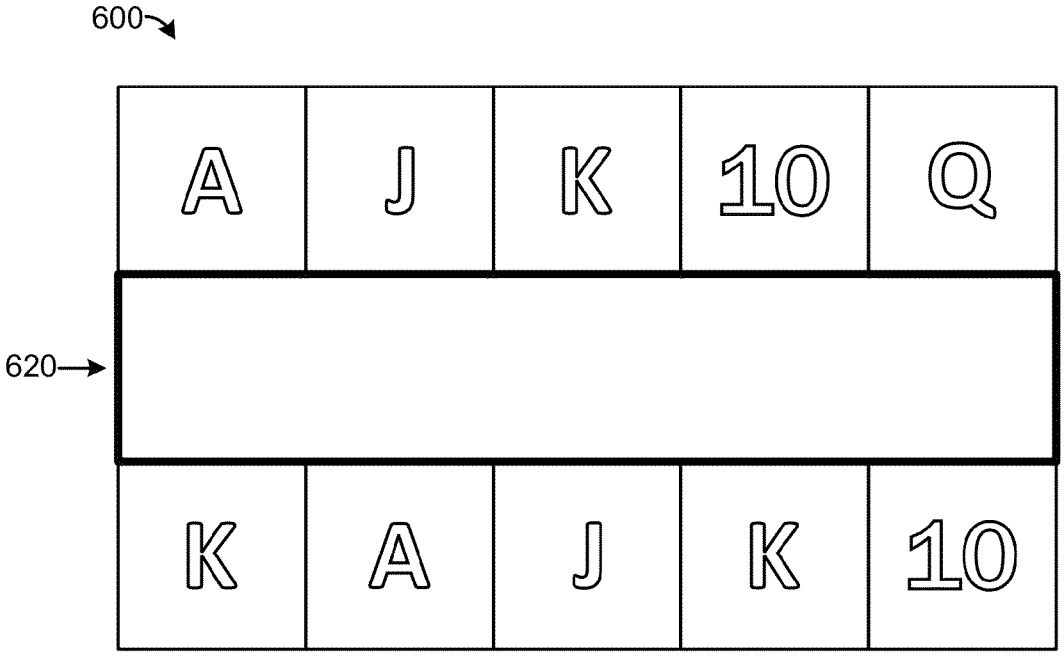
FIG. 6D is an illustration of a super wheel game play, according to one embodiment.

FIG. 6D is an illustration of a super wheel game play, according to one embodiment. Second image 600 may include a horizontal super spin wheel 620. In this example, a player may have selected to utilize the super spin wheel as a horizontal row. The player may have selected any row (e.g., the player may have selected the first row, the second row, and/or the third row as the super spin wheel). In this example, the first and third rows may then spin in normal mode, then the player may have the manual option to spin the super wheel using hand icon 608, the touch screen, a physical pull reel on the outside of the gaming device which may correspond to the spinning super wheel on the screen, and/or any other selecting method to manually start the super spin wheel game. In this example, the player may have clicked on yes button 608 when asked if they would like to use the super spin wheel (see FIG. 6A).

Figure 7A:
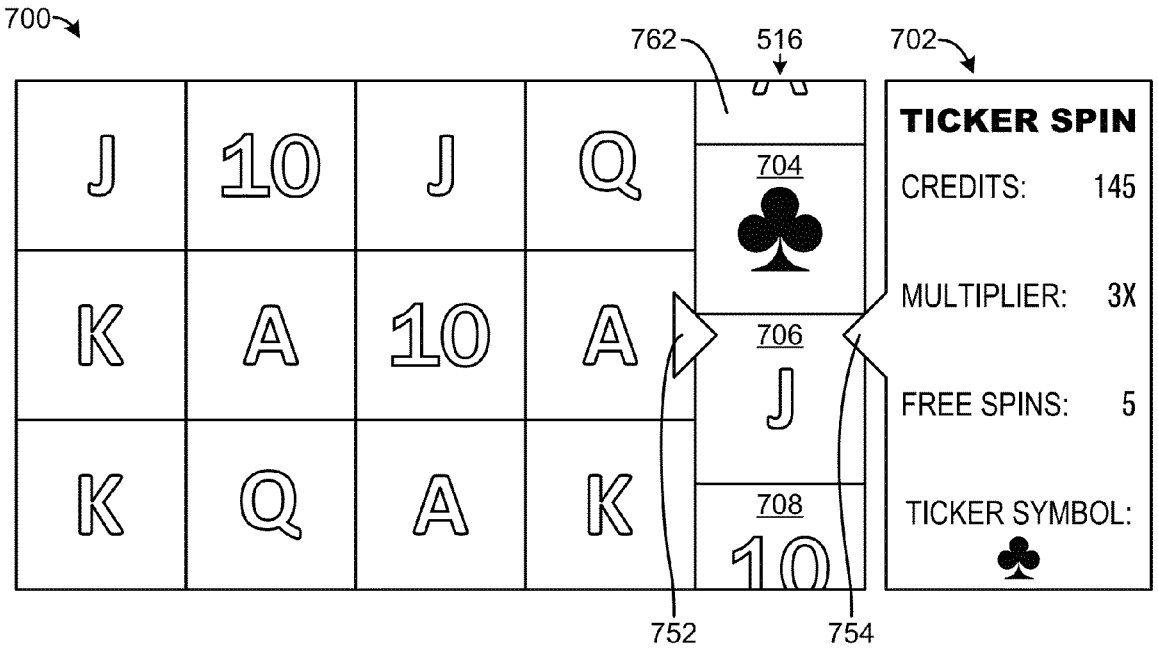
FIG. 7A is an illustration of a ticker game play with a ticker spin menu, according to one embodiment.

FIG. 7A is an illustration of a ticker game play with a ticker spin menu, according to one embodiment. A fifth image 700 may include a ticker symbol message board 702, a ticker symbol 704, a first non-ticker symbol 706, a second non-ticker symbol 708, a first left ticker 752, a first right ticker 754, and a first ticker reel 762. Ticker symbol message board 702 may list the current amount of credits, multipliers, free spins, ticker symbol, and/or any other information. Ticker symbol 704 may pass by first left ticker 752 and/or first right ticker 754 for a winning event to occur. For a winning event to occur the ticker symbol may only need to pass by one of first left ticker 752 and/or first right ticker 754. First ticker reel 762 may have been selected as the ticker reel. In this example, first ticker reel 762 is in the fifth reel, but any reel, row, and/or image may be used (See FIGS. 7C, 7D and/or 7E). The ticker symbol may be predetermined, selected by the player at the time of the game, saved on the player's card, a photograph taken by the camera on electronic gaming device 100 and/or electronic system 200, and/or any other image. In this example, ticker symbol 704 is a club, but it may be any image. In one example, the player may select one or more symbols to play as one or more tickers. In this example, the player has decided to play a game with a ticker reel. When the ticker symbol passes first left ticker 752 and/or first right ticker 754 the player may receive a prize (e.g., free spins, multiplier, credits, etc.). When any non-ticker symbols, such as first non-ticker symbol 706 and second non-ticker symbol 708, pass first left ticker 752 and/or first right ticker 754, the player may not receive a reward. The images displayed on first ticker reel 762 may move from top to bottom, from bottom to top, from left to right, and/or it may spin in any other way. The ticker option may be utilized on any reel, row, and/or image. When the ticker symbol passes first left ticker 752 and/or first right ticker 754, even if the spin does not stop, the player may receive a prize. The ticker symbol passing first left ticker 752 and/or first right ticker 754 may be very valuable because it may add up quickly. In another example, every time a ticker symbol (or symbols) passes the ticker an award (e.g., credits, spins, multipliers, etc.) may be generated.

For example, the player may play a game in which each time the ticker symbol passes first left ticker 752 and/or first right ticker 754 the player receives 100 credits. In this situation, if the ticker symbol passes first left ticker 752 and/or first right ticker 754 four times before stopping, the player may receive 400 credits. In another example, the player may play a game in which each time the ticker symbol passes first left ticker 752 and/or first right ticker 754, the player receives 3× the credits obtained by the player. In this situation, if the player has won 10 credits, and the ticker symbol passes first left ticker 752 and/or first right ticker 754 four times, the player may then have 30 credits. In another example, the player may play a game in which each time the ticker symbol passes first left ticker 752 and/or first right ticker 754, the player receives a free spin. In this situation, if the ticker symbol passes first left ticker 752 and/or first right ticker 754 four times before the spin stops, the player may receive four free spins. A player may also have game play that combines any of the awards (e.g., credits, multipliers, and/or free spins). For example, a player may play a game in which the player received both credits and free spins when the ticker symbol passes first left ticker 752 and/or first right ticker 754. The player may also play a game in which the player receives credits, multipliers, and free spins each time the ticker symbol passes first left ticker 752 and/or first right ticker 754. A player may also play a game in which he may choose during each spin between credits or multipliers, free spins or credits, free spins or multipliers, and/or any combination. The player may also choose between a game in which the player may determine which criteria to use after the spin is complete, allowing the player to choose the option that gives the player the most points. The player may also play a game in which electronic gaming device 100 and/or electronic system 200 chooses which game criteria to be played with the ticker symbol (e.g., credits, multipliers, free spins, and/or any combination). In another example, when a first ticker symbol passes a ticker once a first award (e.g., 100 credits, 1 free spin, etc.) is generated. When the first ticker symbol passes the ticker for a second time, then a second award (e.g., 200 credits, 3 free spins, etc.) is generated. The second award may be greater than a first award. In another example, when the first ticker symbol passes the ticker for a third time, then a third award (e.g., 500 credits, 5 free spins, etc.) is generated. The third award may be greater than a second award.

Figure 7B:
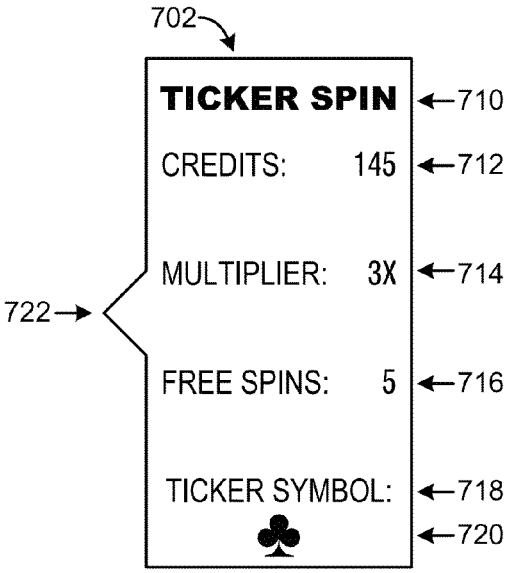
FIG. 7B is an illustration of a ticker spin menu, according to one embodiment.

FIG. 7B is an illustration of a ticker spin menu, according to one embodiment. A fourth image may include ticker symbol message board 702, a ticker 722, a screen header 710, a credit image won 712, a multiplier image 714, a free spin image 716, a ticker symbol header 718, and a ticker symbol 720. Ticker symbol message board 702 may list the current amount of credits, multipliers, free spins, ticker symbol, and/or any other information. Ticker 722 may point to different images as they pass by while they spin and/or when the spin stops. Screen header 710 may state, "Ticker Spin," and/or any other words. Credit image won 712 may display the credits the player currently has won (e.g., in this example, the player currently has 145 credits). Multiplier image 714 may display what multiplying number may be used when the ticker symbol passes the ticker if in multiplying game mode. Free spin image 716 may list how many free spins the player currently possesses and/or the free spin award currently in use in the ticker game mode. Ticker symbol header 718 may show what the ticker symbol is for the game. Ticker symbol 720 may show which image is being used as the current ticker image in the game. Each time the ticker symbol passes the ticker, the player may receive a reward. When any non-ticker symbols pass ticker 722, the player may not receive a reward. In this example, ticker symbol 720 is a club symbol, but it may be any image. In this example, the player may decide which ticker option or options they would like to play. The player may choose credits, multiplier, free spin, and/or any combination. The player may also play a game in which he elects that electronic gaming device 100 and/or electronic system 200 chooses which game criteria be played (e.g., credits, multipliers, free spins, and/or any combination). The ticker spin option may be utilized on any reel, row, and/or image.

The player may also choose a game in which the player always receives credits, but only receives free spins if the ticker symbol passes the ticker three times, and/or any other number of times. The player may also choose a game in which he always receives a multiplier, but only receives credits if the ticker symbol passes the ticker twice, and never receives a free spin. Any combination of any of the criteria may be used. The player may change the ticker symbol at any point.

Figure 7C:
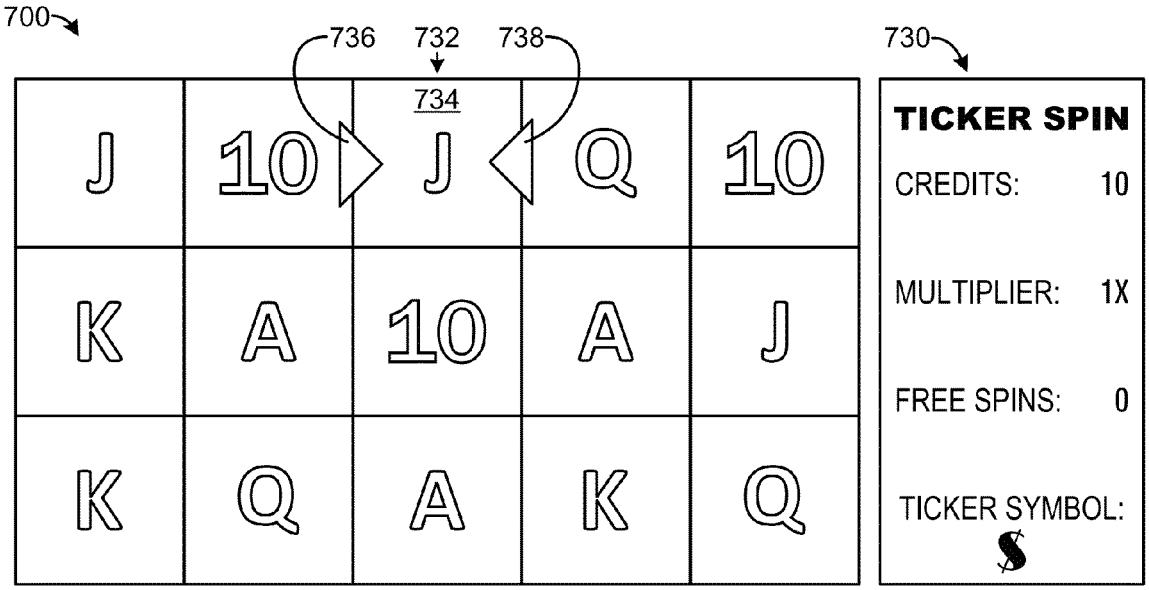
FIG. 7C is another illustration of a ticker game play with a ticker spin menu, according to one embodiment.

FIG. 7C is an illustration of a ticker game play with a ticker spin menu, according to one embodiment. Fifth image 700 may include a second left ticker 736, a second right ticker 738, a second ticker reel 732, a third non-ticker symbol 734, and ticker symbol message board 702. For a winning event to occur, a ticker symbol may pass by second left ticker 736 and/or second right ticker 738. In this example, second ticker reel 732 is in the third reel, but any reel, row, and/or image may be used (See FIGS. 7A, 7D and/or 7E). In this example, the ticker symbol is the dollar sign, but it may be any image. In this example, the player has decided to play a game with a ticker reel. When the ticker symbol, a dollar sign in this example, passes second left ticker 736 and/or second right ticker 738, the player may receive a reward (e.g., free spins, multiplier, credits, etc.). When any non-ticker symbols, such as third non-ticker symbol 734, pass second left ticker 736 and/or second right ticker 738, the player may not receive a reward. The images displayed on second ticker reel 732 may move from top to bottom, from bottom to top, from left to right, and/or it may spin in any other way. The ticker option may be utilized on any reel, row, and/or image. When the ticker symbol passes second left ticker 736 and/or second right ticker 738, even if the spin does not stop, the player may receive a reward.

For example, the player may play a game in which each time the ticker symbol passes second left ticker 736 and/or second right ticker 738 the player receives 100 credits. In this situation, if the ticker symbol passes second left ticker 736 and/or second right ticker 738 four times before stopping, the player may receive 400 credits. In another example, the player may play a game in which each time the ticker symbol passes second left ticker 736 and/or second right ticker 738, the player receives 3× the credits the player currently has won. In this situation, if the player has won 10 credits, and the ticker symbol passes second left ticker 736 and/or second right ticker 738 four times, the player may then have 810 credits. In another example, the player may play a game in which each time the ticker symbol passes second left ticker 736 and/or second right ticker 738, the player receives a free spin. In this situation, if the ticker symbol passes second left ticker 736 and/or second right ticker 738 four times before the spin stops, the player may receive four free spins. A player may also play any combination of credits, multipliers, and/or free spins. For example, a player may play a game in which the player received both credits and free spins when the ticker symbol passes second left ticker 736 and/or second right ticker 738. The player may also play a game in which the player receives credits, multipliers, and free spins each time the ticker symbol passes second left ticker 736 and/or second right ticker 738. A player may also play a game in which he may choose during each spin between credits or multipliers, free spins or credits, free spins or multipliers, and/or any combination. The player may also choose between a game in which the player may determine which to use after the spin is complete, allowing the player to choose the option that gives the player the most points. The player may also play a game in which he elects that electronic gaming device 100 and/or electronic system 200 chooses which game criteria are played with the ticker symbol (e.g., credits, multipliers, free spins, and/or any combination).

Figure 7D:
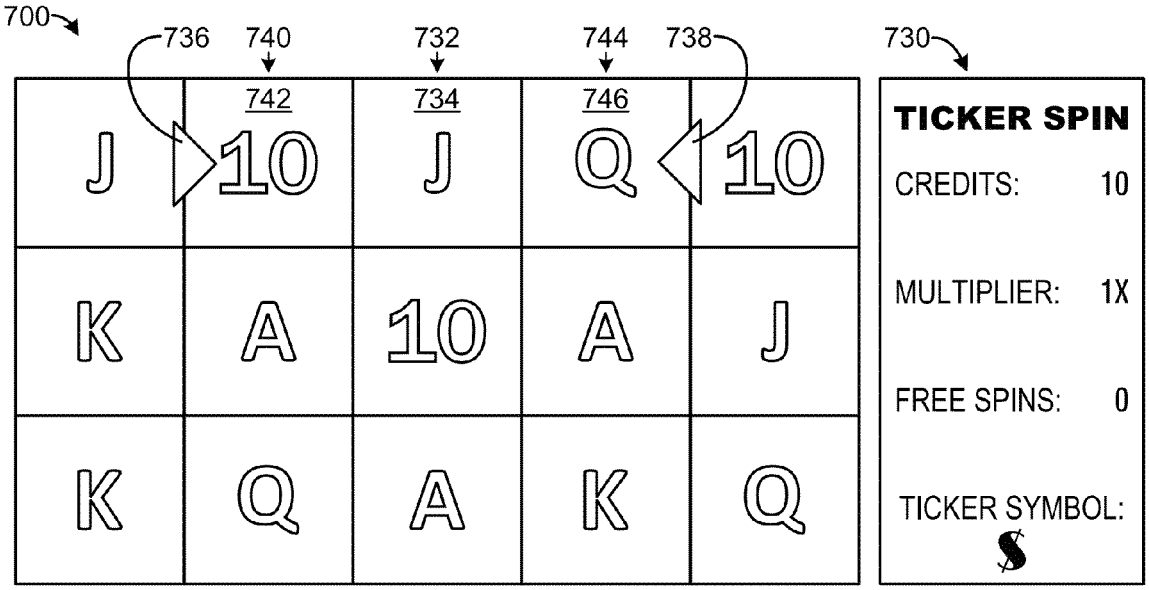
FIG. 7D is another illustration of a ticker game play with a ticker spin menu, according to one embodiment.

FIG. 7D is an illustration of a ticker game play with a ticker spin menu, according to one embodiment. Fifth image 700 may include a third left ticker 756, a third right ticker 758, a first box in ticker row 740, a second box in ticker row 760, a third box in ticker row 744, a fourth non-ticker symbol 742, third non-ticker symbol 734, a sixth non-ticker symbol 746, and ticker symbol message board 702. For a winning event to occur, a ticker symbol may pass by third left ticker 756 and/or third right ticker 758. In this example, the three boxes in the first row have been chosen as the ticker reel, but any reel, row, and/or image may be used (See FIGS. 7A, 7C and/or 7E). In this example, three of the first images (first box in ticker row 740, second box in ticker row 760 and third box in ticker row 744) in three reels (the second reel, the third reel, and the fourth reel) have been chosen as the ticker reel or it can be $2^{nd}$ reel, $3^{rd}$ reel, $4^{th}$ reel, etc. Any of the reels may be chosen, any of the rows may be chosen, and/or any of the images may be chosen. In this example, three boxes were chosen, but any number of boxes (e.g., 1, 2, 5, 10, etc.) may be chosen. In this example, first box in ticker row 740, a second box in ticker row 760, and third box in ticker row 744 have been chosen as the ticker reel. When the ticker symbol, a dollar sign in this example, passes third left ticker 756 and/or third right ticker 758, the player may receive a reward (e.g., free spins, multiplier, credits, etc.). When any non-ticker symbols, such as fourth non-ticker symbol 742, third non-ticker symbol 734, and sixth non-ticker symbol 746, pass second third left ticker 756 and/or third right ticker 758, the player may not receive a reward. The ticker symbol may be predetermined, randomly selected, shuffle, selected by the player at the time of the game, saved on the player's card, and/or a photograph taken by the camera on electronic gaming device 100 and/or electronic system 200, and/or any other image. In this example, the ticker symbol is the dollar sign, but it may be any image. The images displayed on the ticker reel may move from top to bottom, from bottom to top, from left to right, and/or it may spin in any other way. The ticker option may be utilized on any reel, row, and/or image. When the ticker symbol passes third left ticker 756 and/or third right ticker 758, even if the spin does not stop, the player may receive a reward.

For example, the player may play a game in which each time the ticker symbol passes third left ticker 756 and/or third right ticker 758 the player receives 100 credits. In this situation, if the ticker symbol passes third left ticker 756 and/or third right ticker 758 four times before stopping, the player may be receive 400 credits. In another example, the player may play a game in which each time the ticker symbol passes third left ticker 756 and/or third right ticker 758, the player receives 3× the credits the player current has won. In this situation, if the player has 10 credits, and the ticker symbol passes third left ticker 756 and/or third right ticker 758 four times, the player may then have 40 credits. In another example, the player may play a game in which each time the ticker symbol passes third left ticker 756 and/or third right ticker 758, the player receives a free spin. In this situation, if the ticker symbol passes second third left ticker 756 and/or third right ticker 758 four times before the spin stops, the player may receive four free spins. The player may also play any combination of credits, multipliers, and free spins. For example, the player may play a game in which the player received both credits and free spins when the ticker symbol passes third left ticker 756 and/or third right ticker 758. The player may also play a game in which the player receives credits, multipliers, and free spins each time the ticker symbol passes third left ticker 756 and/or third right ticker 758. The player may also play a game in which he may choose during each spin between credits or multipliers, free spins or credits, free spins or multipliers, and/or any combination. The player may also choose between a game in which the player may determine which to use after the spin is complete, allowing the player to choose the option that gives the player the most points.

Figure 7E:
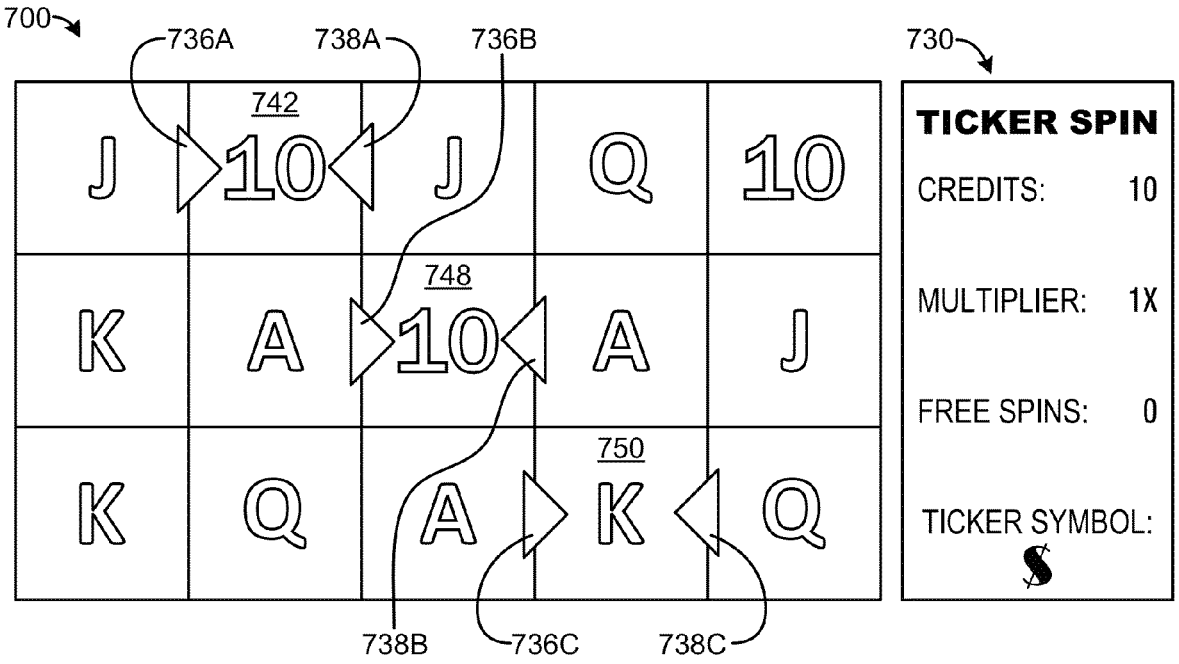
FIG. 7E is an illustration of a game play with a ticker spin menu, according to one embodiment.

FIG. 7E is an illustration of a game play with a ticker spin menu, according to one embodiment. Fifth image 700 may include a fourth left ticker 736A, a fourth right ticker 738A, a fifth left ticker 736B, a fifth right ticker 738B, a six left ticker 736C, a six right ticker 738C, fourth non-ticker symbol 742, a fifth box in ticker row 748, a sixth box in ticker row 750, and ticker symbol message board 702. For a winning event to occur, a ticker symbol may pass by fourth left ticker 736A, fourth right ticker 738A, fifth left ticker 736B, fifth right ticker 738B, sixth left ticker 736C, and/or sixth right ticker 738C. In this example, the three boxes (fourth non-ticker symbol 742 happened to be located in the first row, fifth box in ticker row 748 happened to be located in the second row, and sixth box in ticker row 750 happened to be located in the third row) have been chosen as the ticker reel, but any reel, row, and/or image may be used (See FIGS. 7A, 7C and/or 7D). In this example, three images have been chosen for the ticker spin in three different rows and three different reels (first box in the second reel, second box in the third reel, third box in the fourth reel). Any of the reels may be chosen, any of the rows may be chosen, and/or any of the images may be chosen. In this example three boxes were chosen, but any number of boxes (e.g., 1, 2, 5, 10, etc.) may be chosen for the ticker spin. In this example, fourth non-ticker symbol 742, fifth box in ticker row 748, and sixth box in ticker row 750 have been chosen as the ticker reel.

When the ticker symbol, a dollar sign in this example, passes fourth left ticker 736A and fourth right ticker 738A, fifth left ticker 736B and fifth right ticker 738B, and/or sixth left ticker 736C and sixth right ticker 738C, the player may receive a reward (e.g., free spins, multiplier, credits, etc.). When any non-ticker symbols passes fourth left ticker 736A, fourth right ticker 738A, fifth left ticker 736B, fifth right ticker 738B, sixth left ticker 736C, and/or sixth right ticker 738C, the player may not receive a reward. In another example, when the ticker symbol passes fourth left ticker 736A and fourth right ticker 738A, fifth left ticker 736B and fifth right ticker 738B, and/or sixth left ticker 736C and sixth right ticker 738C, even if the spin does not stop, the player may receive a reward. The ticker symbol passing fourth left ticker 736A and fourth right ticker 738A, fifth left ticker 736B and fifth right ticker 738B, and/or sixth left ticker 736C and sixth right ticker 738C may be very valuable because it may add up quickly. Ticker symbol message board 702 may list the current amount of credits, multipliers, free spins, ticker symbol, and/or any other information.

For example, the player may play a game in which each time the ticker symbol passes fourth left ticker 736A, fourth right ticker 738A, fifth left ticker 736B, fifth right ticker 738B, sixth left ticker 736C, and/or sixth right ticker 738C the player receives 100 credits. In this situation, if the ticker symbol passes fourth left ticker 736A and fourth right ticker 738A, fifth left ticker 736B and fifth right ticker 738B, and/or sixth left ticker 736C and sixth right ticker 738C four times before stopping, the player may be receive 400 credits. In another example, the player may play a game in which each time the ticker symbol passes fourth left ticker 736A, fourth right ticker 738A, fifth left ticker 736B, fifth right ticker 738B, sixth left ticker 736C, and/or sixth right ticker 738C, the player receives a free spin. In this situation, if the ticker symbol passes fourth left ticker 736A and fourth right ticker 738A, fifth left ticker 736B and fifth right ticker 738B, and/or sixth left ticker 736C and sixth right ticker 738C four times before the spin stops, the player may receive four free spins. The player may also play any combination of credits, multipliers, and free spins. For example, the player may play a game in which the player received both credits and free spins when the ticker symbol passes fourth left ticker 736A and fourth right ticker 738A, fifth left ticker 736B and fifth right ticker 738B, and/or sixth left ticker 736C and sixth right ticker 738C. The player may also play a game in which the player receives credits, multipliers, and free spins each time the ticker symbol passes fourth left ticker 736A and fourth right ticker 738A, fifth left ticker 736B and fifth right ticker 738B, and/or sixth left ticker 736C and sixth right ticker 738C. The player may also play a game in which a combination of criteria is being used each in a different box (e.g., If a ticker symbol passes fourth left ticker 736A and fourth right ticker 738A the multiplier is awarded, if the ticker passes fifth left ticker 736B and fifth right ticker 738B the free spins are awarded, and if a ticker symbol passes sixth left ticker 736C and sixth right ticker 738C credits are awarded). The player may also play a game in which all of the criteria is being used in each of the ticker reel boxes (e.g., if a ticker symbol passes fourth left ticker 736A and fourth right ticker 738A the multiplier, free spin, and credits are awarded, if the ticker passes fifth left ticker 736B and fifth right ticker 738B the multiplier, free spin, and credits are awarded, and if a ticker symbol passes sixth left ticker 736C and sixth right ticker 738C the multiplier, free spin, and credits are awarded).

Figure 8:
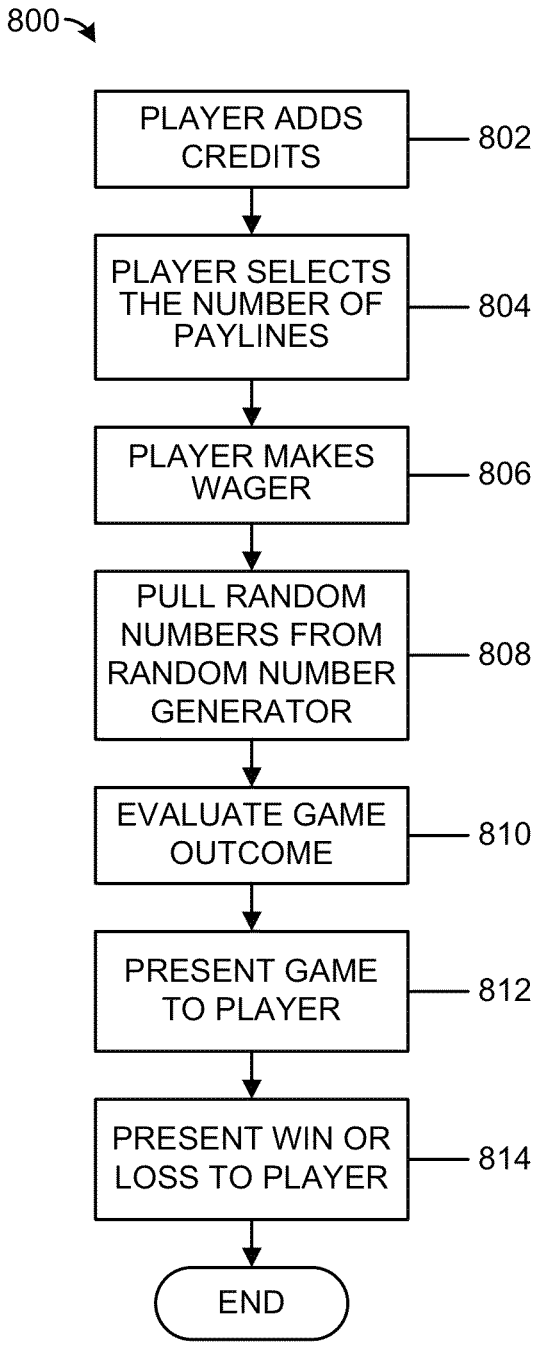
FIG. 8 is a flow diagram for game play, according to one embodiment.

In FIG. 8, a first process flowchart 800 of game play is shown, according to one embodiment. The method may include the game play starting. The method may include electronic gaming device 100 and/or electronic gaming system 200 receiving credits (step 802). The method may include electronic gaming device 100 and/or electronic gaming system 200 receiving payline selections from a player (step 804). The method may include electronic gaming device 100 and/or electronic gaming system 200 receiving a wager (step 806). The method may include electronic gaming device 100 and/or electronic gaming system 200 pulling one or more random numbers from a random number generator (step 808). The method may include electronic gaming device 100 and/or electronic gaming system 200 evaluating the game outcome (step 810). The method may include presenting the game (step 812). The method may include displaying the game outcome (step 814). The method may end.

Figure 9:
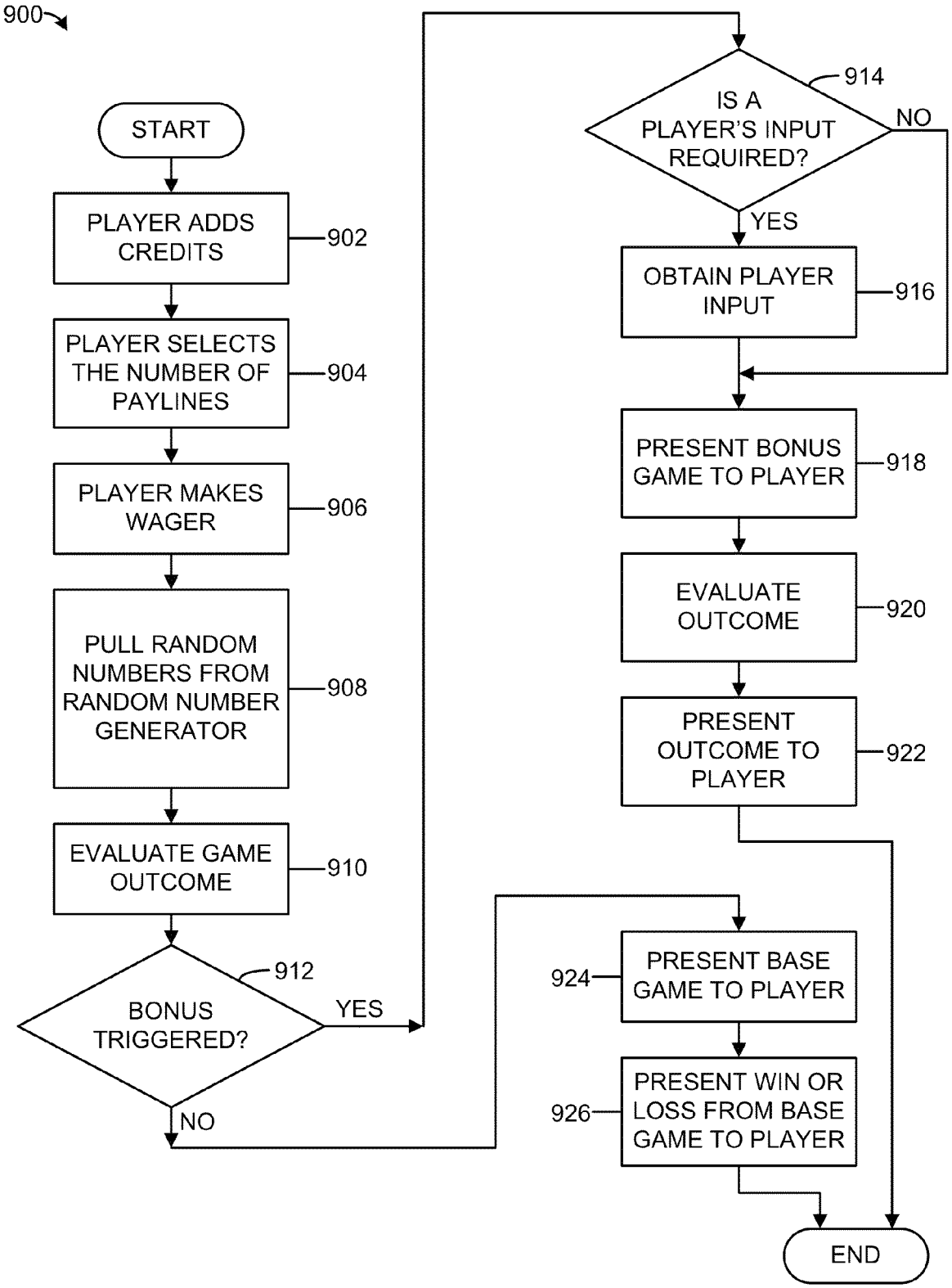
FIG. 9 is another flow diagram for game play, according to one embodiment.

FIG. 9 is a process flowchart of one example of a combined primary and secondary game play 900 on an electronic gaming system, according to one embodiment. The method may include the step of a player adding credit to the electronic gaming system 902. It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 904, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 906, the player makes a wager on the game. In one embodiment, the wager may be a multiple of the number of paylines selected at step 904. In another embodiment, the wager may not be a multiple of the number of paylines selected at step 904. In a further embodiment, the wager may include a side-wager, which may, in one example of such an embodiment, be used to make the player eligible to be awarded the extra functionality discussed above. It should be appreciated that in some embodiments, the order of steps 904 and 906 may not be critical, and so for example, a player can select the wager they wish to place, and then select the number of paylines they want it applied to, and that these embodiments are expressly contemplated as being within the scope of the present disclosure.

Continuing to step 908, the gaming system pulls random numbers from a random number generator ("RNG"). In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At step 910, the gaming system utilizes the random numbers pulled at step 908 to evaluate the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 912, the gaming system determines if a secondary or bonus game may be triggered. In one embodiment, the bonus game may be triggered by the display of a plurality of matching symbols at a plurality of predetermined symbol positions within a play of the primary game. In one example, the bonus game may be triggered if a plurality of matching symbols are displayed on the $2^{nd}$, $3^{rd}$ and $4^{th}$ reel (and/or any combination of symbols on any combination of reels, randomly, predetermined pattern, etc.). In another example, the bonus game may be triggered if matching symbols are displayed on the $1^{st}$, $2^{nd}$ and $3^{rd}$ reel. In a further example, the bonus game may be triggered if matching symbols occur at predetermined symbol positions that include consecutive and non-consecutive reels.

If it is determined that a bonus or secondary game was not triggered, the process continues to step 924, where the base game is partially presented to the player. As discussed above, the orders of step 910, 912, and 924 can be changed without affecting the novel concepts disclosed herein.

At step 926, the win or loss outcome of the partial primary game may be identified for the player. In one embodiment, this step can include additional messaging, which provides information related to the win or loss, such as why the player won or lost. In another embodiment, this step can include identification of the amount of any award earned by the player If it is determined at step 912 that a bonus or secondary game was triggered, then process 900 continues to step 914, where the gaming system determines if player input is required to play the secondary game. If player input is required, the process continues to step 916, where player input may be obtained via at least one player input device. In one embodiment, the player utilizes a touchscreen input device associated with the gaming system in order to make selections. In another embodiment, the player utilizes a button input device to make selections. In further embodiments, the player utilizes a mouse, touchpad, trackball, keyboard, gestures, voice commands, optical recognition, and/or any combination thereof to make selections.

Once player input is obtained, or if no player input is required, process 900 continues to step 918, where the bonus game may be presented to the player. In one example, this step may include the presentation of selections for the player. At steps 920 and 922, the outcome of the secondary game may be evaluated and presented to the player. In one embodiment, the outcome of the bonus game will always be a winning outcome. In another embodiment, the outcome of the secondary game will cause a significant award to be provided to the player. In one example of such an embodiment, the award may not be provided by the gaming system, as a casino operator may need to verify tax information before allowing such an award to be provided to the player. In one embodiment, steps 918-922 cause the need for additional player input, so they may need to loop back to step 914 in order to receive such additional player input. In one embodiment, instead of the process 900 ending after step 922, the process continues to step 924 so as to finalize the primary game outcome presentation to the player.

Figure 10:
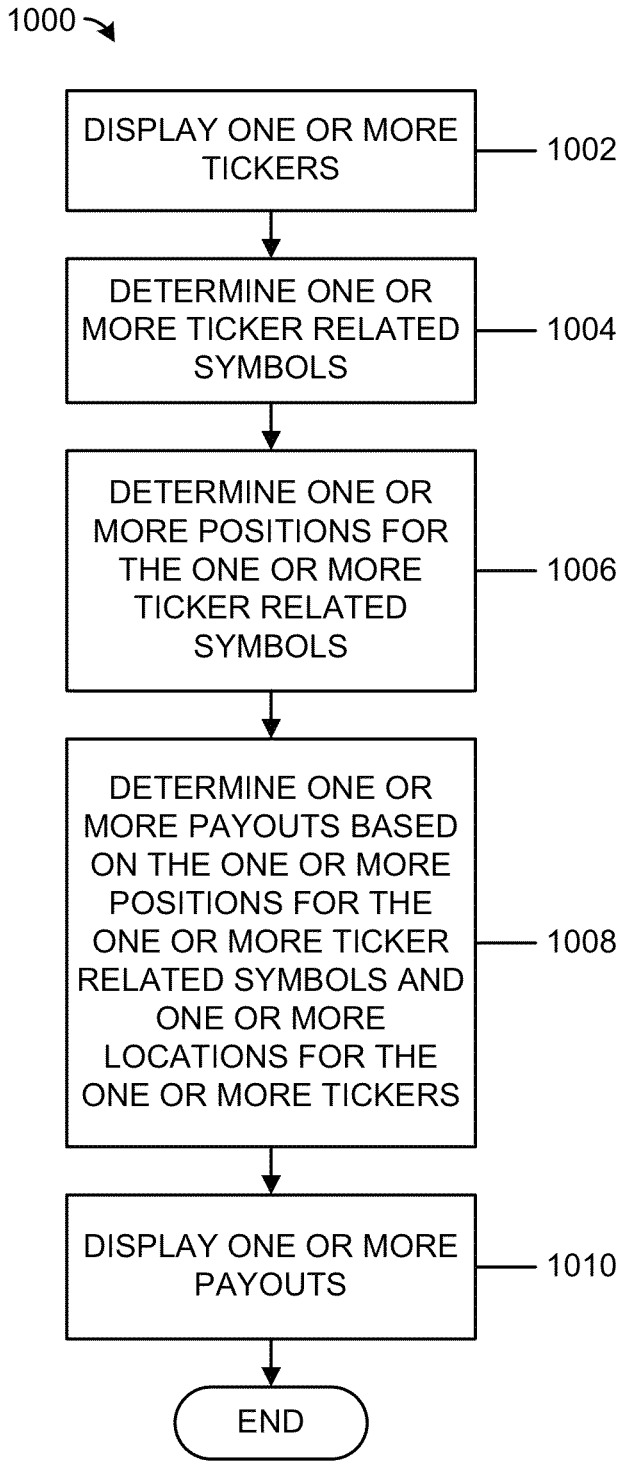
FIG. 10 is another flow diagram for game play, according to one embodiment.

FIG. 10 is another flow diagram for game play, according to one embodiment. FIG. 10 shows a third process flowchart 1000 for game play. The method may include electronic gaming device 100 and/or electronic gaming system 200 displaying one or more tickers (step 1002). Further, the method may include electronic gaming device 100 and/or electronic gaming system 200 determining one or more ticker related symbols (step 1004). The method may include electronic gaming device 100 and/or electronic gaming system 200 determining one or more positions for the one or more ticker related symbols (step 1006). The method may include electronic gaming device 100 and/or electronic gaming system 200 determining one or more payouts based on the one or more positions for the one or more positions for the one or more ticker related symbols and one or more locations for the one or more tickers (step 1008). The method may include electronic gaming device 100 and/or electronic gaming system 200 displaying one or more payouts (step 1010). The method may then end (step 1012).

Electronic gaming device 100 and/or electronic gaming system 200 may display one or more tickers (step 1004). For example, electronic gaming device 100 and/or electronic gaming system 200 may allow the player to chosen the ticker symbol. The player may browse the saved images and select one of those images to use in game play. In another example, electronic gaming device 100 and/or electronic gaming system 200 may chose an image.

In another example, electronic gaming device 100 and/or electronic gaming system 200 may determine one or more positions for the one or more ticker related symbols (step 1006). The position for the one or more ticker related symbols may occur on any reel, row, and/or image. The position may be any number on a reel (e.g., 1, 2, 3, etc.), and number on a row (e.g. 1, 2, 3, etc.), and/or any number of images on the plurality of reels (e.g., 1, 2, 5, 10, etc.).

Electronic gaming device 100 and/or electronic gaming system 200 may determine one or more positions for the one or more ticker related symbols (step 1006). Electronic gaming device 100 and/or electronic gaming system 200 may allow the player to determine the positions for the one or more ticker related symbols and/or electronic gaming device 100 and/or electronic gaming system 200 may determine the positions. The ticker related symbols may be placed on any location. For example, positions for the ticker related symbols may be located on the first box of reel one, the second box of reel two, and the third box of reel three. In another example, the ticker related symbols may be located on all of the boxes of the first reel. In another example, the ticker related symbols may be located on all of the boxes of the fifth reel. In another example, the ticker related symbols may be located in all of the boxes of the second row. In another example, the ticker related symbols may be located in the second box of the first reel, the second reel, the third reel, and the fourth reel. Any combination of reels, rows, and/or any symbol areas may be used. For example, electronic gaming device 100 and/or electronic gaming system 200 may allow the player to determine the placement of the ticker related symbols. In one game, the player may place the ticker related symbols in all of the boxes of the second row. In another example, the player may place the ticker related symbols in the second box of the first reel, the second reel, the third reel, and the fourth reel. Electronic gaming device 100 and/or electronic gaming system 200 may also select the location of the ticker related symbols. Electronic gaming device 100 and/or electronic gaming system 200 may base the location of the ticker related symbols off of one or more profiles on the player's card, use the player's history to determine the parameter that may take the player the longest, randomly select criteria, and/or use any other method to determine the criteria.

Electronic gaming device 100 and/or electronic gaming system 200 may determine one or more payouts based on the one or more positions for the one or more positions for the one or more ticker related symbols and one or more locations for the one or more tickers (step 1008). The payout for each position may be different. For example, gaming device 100 and/or electronic gaming system 200 may determine a payout of credits for the first ticker location, a payout of free spins for a second ticker location, and/or a multiplier payout for a third ticker location. In another example, electronic gaming device 100 and/or electronic gaming system 200 may determine to award all payouts (e.g., free spin, multiplier, credits, etc.) to one of the ticker locations. In another example, gaming device 100 and/or electronic gaming system 200 may determine to award all payouts (e.g., free spin, multiplier, credits, etc.) to one ticker location, a single payout (e.g., free spin) to a second ticker location, and two payouts (e.g., free spin and credits) to a third ticker location. Electronic gaming device 100 and/or electronic gaming system 200 may determine to award different payouts after a different number of spins has occurred (e.g. free spin if the ticker symbol has passes the ticker once, credits if the ticker symbol has passes the ticker twice, multiplier if the ticker symbol has passes the ticker symbol three times). In another example, electronic gaming device 100 and/or electronic gaming system 200 may determine to award different payouts after a different number of spins has occurred (e.g. free spin if the ticker symbol has passes the ticker only once and credits if the ticker symbol has passes the ticker only twice). In one example, when a first ticker symbol passes a ticker a first award (e.g., 100 credits) may be generated. In this example, when a second ticker symbol passes the ticker a second award (e.g., 500 credits) may be generated. In this example, when a third ticker symbol passes the ticker a third time, then a third award (e.g., 1,000 credits) may be generated. In another example, once second ticker symbol passes the ticker for a second time a higher award (e.g., 1,500 and 2 free spins) than the second award may be generated based on passing the ticker twice. In another example, if first ticker symbol passes ticker before the second ticker symbol passes ticker, then no award is generated. However, if first ticker symbol passes ticker after the second ticker symbol passes ticker, then an award is generated. In another example, second ticker symbol may have to pass a predetermined number (e.g., 1 to N) before an award may be generated for another ticker symbol (e.g., first ticker symbol) passing by ticker. In another example, the more times a ticker symbol passes by ticker may escalate the award for ticker symbol passing by ticker and/or another ticker symbol passing by ticker.

Electronic gaming device 100 and/or electronic gaming system 200 may display one or more payouts in the ticker symbol message board, in the center of the screen on a pop-up window, in any location on the screen (e.g., left, right, middle, left upper corner, right lower corner, etc.), on the keypad, on an overhead display, and/or in any other location. The payout listed may blink, shift, change size, change color, and/or move in any way. The method may then end (step 1012).

In an exemplary embodiment, an electronic gaming device may include a plurality of reels. The plurality of reels may include a plurality of symbols. The electronic gaming device may include a first payline, a second payline, and a memory. The memory may include a payline module. The payline module may include a plurality of payline structures. The electronic gaming device may include a processor. The processor may receive primary wagers on one or more paylines. The processor may receive one or more secondary wagers on one or more selected paylines (e.g., $5^{th}$ reel functions, reel functions, etc.). The selected paylines may be based on data received from a player. The processor may determine a selected payline's payout based on the one or more selected paylines (e.g., $5^{th}$ reel functions, reel functions, etc.).

In another embodiment, the processor may determine a payout based on the primary wagers. The electronic gaming device may include a network interface, which may receive data from at least one of a server and one or more gaming devices. The electronic gaming device may include a display, which may display one or more selected paylines.

In another example, the method may include obtaining a player preference data and modifying a game configuration based on the player preference data. The method may include receiving data from at least one of a server and one or more gaming devices. The method may include multiplying a prize value based on a selected payline occurrence.

Figure 11:
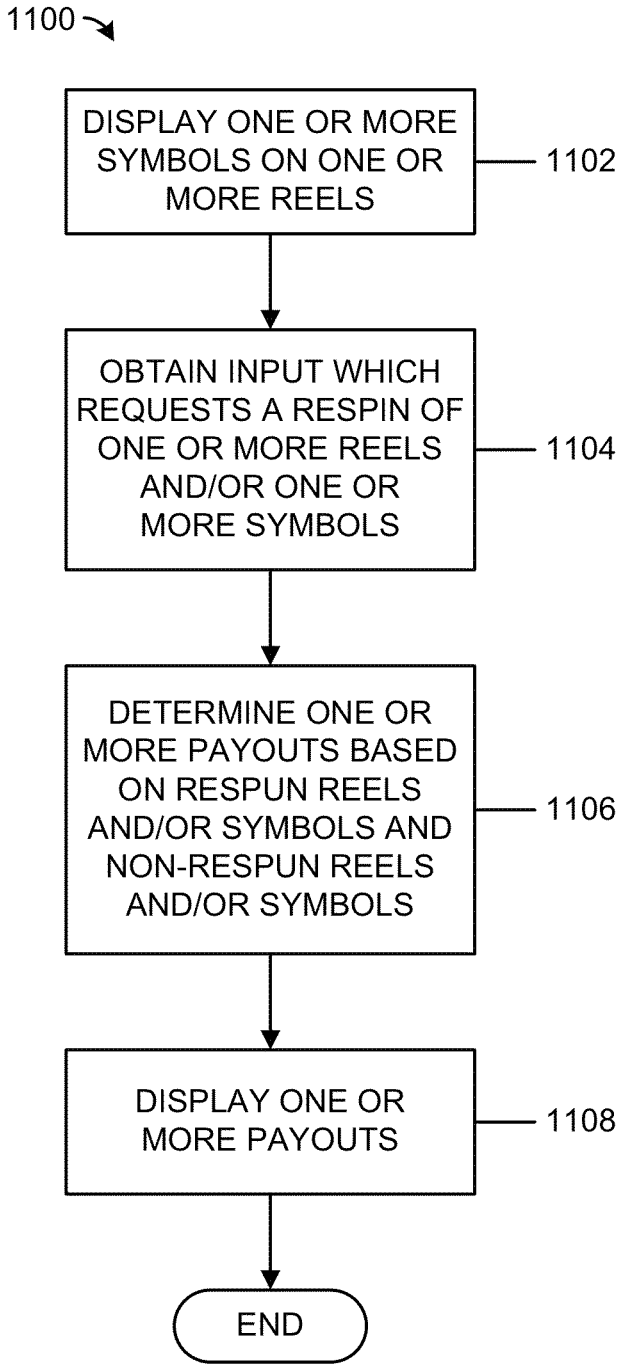
FIG. 11 is another flow diagram for game play, according to one embodiment.

In FIG. 11, a flow chart for $5^{th}$ reel (and/or any other reel) game play is shown, according to one embodiment. The method may include displaying one or more symbols on one or more reels (step 1102). The method may include obtaining an input which requests a respin of one or more reels and/or one or more symbol areas (step 1104). The method may include determining one or more payouts based on or more respun reels and/or one or more respun symbols and/or one or more non-respun reels and/or one or more non-respun symbols (step 1106). The method may include displaying one or more payouts (step 1108).

Figure 12:
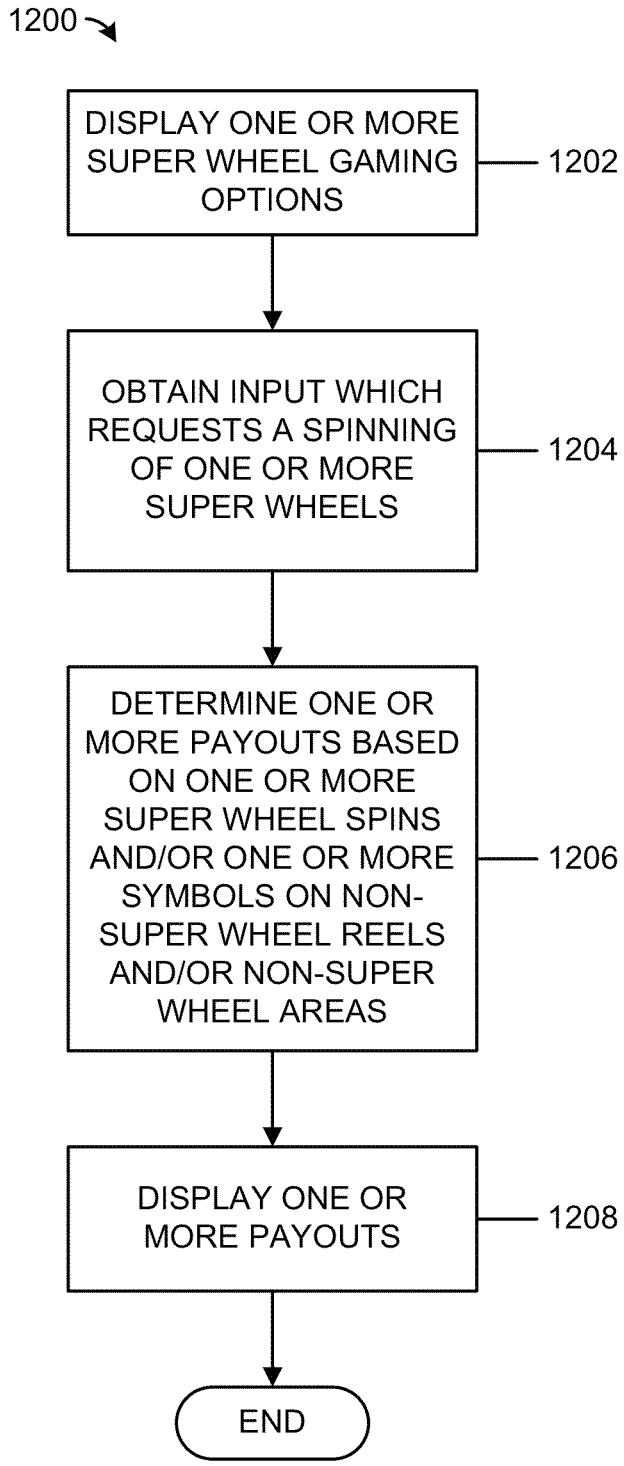
FIG. 12 is another flow diagram for game play, according to one embodiment.

In FIG. 12, a flow chart for super wheel game play is shown, according to one embodiment. The method may include displaying one or more super wheel gaming options (step 1202). The method may include obtaining input which requests a spinning of one or more super wheels (step 1204). The method may include determining one or more payouts based on one or more super wheel spins and/or one or more symbols on one or more non-super wheel reels and/or one or more non-super wheel areas (step 1206). The method may include displaying one or more payouts (step 1208).

The plurality of reels may form a 5-by-5 matrix, a 3-by-5 matrix, a 4-by-5 matrix, a 4-by-3 matrix, a 5-by-3 matrix, or any number-by-any number matrix. The symbols may be an image of a card, an image, and/or other objects. For example, it may be a pot of gold, an ace of spades, a diamond, or any other symbol. The symbols may be animation. The symbols may be a picture. For example, it may be a picture of the player as taken by camera 312. The symbols may be a number. The symbols may be any image. The symbols may be blank.

The disclosed features may be part of the base game and/or a bonus game. In addition, the disclosed features may be part of a base bet and/or may require an additional side bet (e.g., ante bet).

In another example, the processor may initiate one or more additional reel game structures based on one or more triggering events. In another example, the processor may stop one or more additional reel game structures based on a stopping triggering event signal. In one example, an initiated additional reel game play structure may be based on one or more profiles. In one example, the one or more profiles may be based on data from a loyalty card.

In another example, the initiated additional reel game play structure may be based on one or more criteria selections. In one example, the one or more criteria selections may be based on a player's input. In another example, the one or more criteria selections may be based on one or more selections by the electronic gaming device.

In one embodiment, the electronic gaming device may include a plurality of reels. The one or more paylines may be formed on at least a portion of the plurality of reels. The electronic gaming device may include including one or more super wheel game play structures. The electronic gaming device may include a processor which initiates the one or more super wheel game play structures.

In another example, the processor may display the one or more super wheel game play structures based on one or more criteria. In one example, the one or more criteria may be based on data from a random number generator. In an example, the processor may initiate one or more super wheel game play structures based on one or more inputs. In another example, the processor may stop one or more super wheel game structures based on one or more triggering events. In one example, the processor may determine one or more payouts based on one or more wheel positions. In an example, the processor may display the one or more payouts.

In one embodiment, the electronic gaming device may include a plurality of reels. The one or more paylines may be formed on at least a portion of the plurality of reels. The electronic gaming device may include including one or more ticker game play structures. The electronic gaming device may include a processor which initiates the one or more ticker game play structures.

In another example, the processor may display the one or more ticker game play structures based on one or more criteria. In one example, the one or more criteria may be based on data from a random number generator. In an example, the processor may initiate one or more ticker game play structures based on one or more inputs. In another example, the processor may determine one or more ticker based payouts based on one or more triggering events (e.g., ticker symbol passing ticker). In an example, the processor may display the one or more payouts.

In another embodiment, the method of providing gaming options via an electronic gaming device may include one or more of receiving one or more wagers on one or more paylines, displaying one or more super wheel based gaming structures, initiating one or more super wheel based gaming structures based on a received input, spinning one or more super wheels, and/or generating one or more payouts based on the spinning of the one or more super wheels.

In another embodiment, the electronic gaming device may include a plurality of reels. The one or more paylines may be formed on at least a portion of the plurality of reels. The electronic gaming device may include a memory. The memory may include one or more 5th reel game play structures. The electronic gaming device may include a processor which may initiate the one or more 5th reel game play structures.

In another example, the processor may display the one or more 5th reel game play structures based on one or more criteria. In one example, the one or more criteria may be based on data from a random number generator. In another example, the processor may initiate one or more 5th reel game play structures based on one or more inputs. In one example, the processor may stop one or more symbols on one or more 5th reel game structures based on one or more triggering events. In another example, the processor may determine one or more payouts based on the one or more symbols. The processor may display the one or more payouts.

Gaming system may be a "state-based" system. A state-based system stores and maintains the system's current state in a non-volatile memory. Therefore, if a power failure or other malfunction occurs, the gaming system may return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

While there has been illustrated and described what are presently considered to be example features, it may be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed.

The invention claimed is:

1. An electronic gaming device comprising:

a credit device configured to accept a physical item associated with a monetary value;

a user input device configured to enable a player to select a wager amount and initiate a game play where the wager amount is subtracted from a credit balance, the credit balance being funded at least in part via the credit device;

a plurality of display areas;

one or more paylines formed on at least a portion of the plurality of display areas, the plurality of display areas including at least a first reel, a second reel, and a third reel;

a memory, the memory including one or more super wheel game play structures, where the one or more super wheel game play structures includes one or more super wheel game presentations; and a processor configured to initiate a super wheel game play presentation on one of the first reel, the second reel, and the third reel;

wherein an entire implementation of the super wheel game play presentation is implemented on only one reel, where the only one reel is one of the first reel, the second reel, and the third reel, where the super wheel game play presentation includes a wheel image placed over the only one reel and the wheel image including a plurality of wheel areas where the plurality of wheel areas include prize indicia which are different than any symbol located on the only one reel before the wheel image was placed on the only one reel;

wherein the credit balance is increased by any determined award amount associated with game play.

2. The electronic gaming device of claim 1, wherein the processor is further configured to display the one or more super wheel game play structures based on one or more criteria.

3. The electronic gaming device of claim 2, wherein the one or more criteria is based on data from a random number generator.

4. The electronic gaming device of claim 2, wherein the processor is further configured to initiate the one or more super wheel game play structures based on one or more inputs.

5. The electronic gaming device of claim 1, wherein the processor is further configured to stop the one or more super wheel game structures based on one or more triggering events.

6. The electronic gaming device of claim 5, wherein the processor is further configured to determine one or more payouts based on one or more wheel positions.

7. The electronic gaming device of claim 6, wherein the processor is further configured to display the one or more payouts.

8. A method of providing gaming options via an electronic gaming device comprising:

receiving via a credit device a physical item associated with a monetary value;

establishing via one or more processors a credit balance based at least in part on the received item;

receiving via a wager button a wager amount on a play of a game, wherein the wager amount is deducted from the credit balance;

determining a super wheel location, where the super wheel location is on one of a first reel, a second reel, and a third reel; and displaying via the one or more processors a super wheel game play presentation on one of the first reel, the second reel, and the third reel;

wherein an entire implementation of the super wheel game play presentation is implemented on only one reel, where the only one reel is one of the first reel, the second reel, and the third reel, where the super wheel game play presentation includes a wheel image placed over the only one reel and the wheel image including a plurality of wheel areas where the plurality of wheel areas include prize indicia which are different than any symbol located on the only one reel before the wheel image was placed on the only one reel;

wherein the credit balance is increased by any determined award amount associated with game play.

9. The method of claim 8, further comprising initiating one or more super wheel based gaming structures based on a received input.

10. The method of claim 9, further comprising spinning one or more super wheels.

11. The method of claim 10, further comprising generating one or more payouts based on the spinning of the one or more super wheels.

12. An electronic gaming device comprising:

a credit device configured to accept a physical item associated with a monetary value;

a user input device configured to enable a player to select a wager amount and initiate a game play, wherein the wager amount is subtracted from a credit balance funded at least in part via the credit device;

a plurality of display areas;

one or more paylines formed on at least a portion of the plurality of display areas, the plurality of display areas include at least a first reel, a second reel, a third reel, a fourth reel, and a fifth reel;

a memory, the memory including one or more $5^{th}$ reel game play structures, where the one or more $5^{th}$ reel game play structures includes one or more $5^{th}$ reel game play type programs; and a processor configured to initiate the one or more $5^{th}$ reel game play structures on one of the first reel, the second reel, the third reel, the fourth reel, and the fifth reel;

wherein an entire implementation of a $5^{th}$ reel game play structure is implemented on only one reel, where the only one reel is one of the first reel, the second reel, the third reel, the fourth reel, and the fifth reel, where the $5^{th}$ reel game play structure includes one or more tickers which generate a prize when a predetermined symbol pass by a ticker a predetermined number of times;

wherein the credit balance is increased by any determined award amount associated with game play.

13. The electronic gaming device of claim 12, wherein the processor is further configured to display the one or more $5^{th}$ reel game play structures based on one or more criteria.

14. The electronic gaming device of claim 13, wherein the one or more criteria is based on data from a random number generator.

15. The electronic gaming device of claim 13, wherein the processor is further configured to initiate the one or more $5^{th}$ reel game play structures based on one or more inputs.

16. The electronic gaming device of claim 12, wherein the processor is further configured to stop one or more symbols on the one or more $5^{th}$ reel game structures based on one or more triggering events.

17. The electronic gaming device of claim 16, wherein the processor is further configured to determine one or more payouts based on the one or more symbols.

18. The electronic gaming device of claim 17, wherein the processor is further configured to display the one or more payouts.

* * * * *